US010937403B2

(12) United States Patent
Nishida et al.

(10) Patent No.: US 10,937,403 B2
(45) Date of Patent: Mar. 2, 2021

(54) SIGNAL SUPPLY DEVICE, KEYBOARD DEVICE AND NON-TRANSITORY COMPUTER-READABLE STORAGE MEDIUM

(71) Applicant: YAMAHA CORPORATION, Hamamatsu (JP)

(72) Inventors: Kenichi Nishida, Hamamatsu (JP); Yasuhiko Oba, Hamamatsu (JP); Akihiko Komatsu, Hamamatsu (JP); Michiko Tanoue, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/568,960

(22) Filed: Sep. 12, 2019

(65) Prior Publication Data

US 2020/0005747 A1 Jan. 2, 2020

Related U.S. Application Data

(63) Continuation of application No. PCT/JP2018/010043, filed on Mar. 14, 2018.

(30) Foreign Application Priority Data

Mar. 15, 2017 (JP) ..... JP2017-050144

(51) Int. Cl.
*G10H 1/34* (2006.01)
*G10H 1/00* (2006.01)
*G10H 1/053* (2006.01)

(52) U.S. Cl.
CPC ..... *G10H 1/053* (2013.01); *G10H 1/344* (2013.01); *G10H 2220/221* (2013.01); *G10H 2220/395* (2013.01)

(58) Field of Classification Search
CPC ..... G10H 1/00; G10H 1/34; G10H 2220/395; G10H 1/346; G10H 2220/271;
(Continued)

(56) References Cited

U.S. PATENT DOCUMENTS 5,286,915 A 2/1994 Komano
6,297,437 B1 10/2001 Ura
(Continued)

FOREIGN PATENT DOCUMENTS

JP H0365992 A 3/1991
JP H0962255 A 3/1997
(Continued)

OTHER PUBLICATIONS

International Search Report issued in Intl. Appln No. PCT/JP2018/010043 dated Jun. 5, 2018. English translation provided.
(Continued)

*Primary Examiner* — Marlon T Fletcher
(74) *Attorney, Agent, or Firm* — Rossi, Kimms & McDowell LLP

(57) ABSTRACT

A signal supply device according to an embodiment of the present invention includes a generator configured to generate a first sound signal and a second sound signal in accordance with an instruction signal including operation body information corresponding to an operation input to an operation body and linked member information corresponding to a movement of a linked member linked with the operation body and an adjuster configured to adjust a relationship between the first sound signal and the second sound signal on the basis of the operation body information and the linked member information.

20 Claims, 12 Drawing Sheets

(58) Field of Classification Search
CPC ..... G10H 2220/221; G10H 2250/451; G10C 3/18; G10K 11/35
See application file for complete search history.

(56) References Cited

U.S. PATENT DOCUMENTS

| | | | | |
|---|---|---|---|---|
| 7,429,699 | B2 * | 9/2008 | Tajika | G10H 1/346 84/601 |
| 2001/0003945 | A1 * | 6/2001 | Muramatsu | G10F 1/02 84/658 |
| 2005/0247182 | A1 | 11/2005 | Sasaki | |
| 2009/0235803 | A1 * | 9/2009 | Iwamoto | G10H 1/346 84/229 |
| 2010/0326260 | A1 * | 12/2010 | Komatsu | G10H 1/346 84/744 |
| 2011/0132182 | A1 * | 6/2011 | Kikumoto | G10H 1/344 84/744 |
| 2012/0137857 | A1 | 6/2012 | Liu | |
| 2012/0247306 | A1 | 10/2012 | Shimizu | |
| 2016/0098975 | A1 | 4/2016 | Shepherd | |
| 2020/0005746 | A1 * | 1/2020 | Nishida | G10H 1/344 |
| 2020/0005747 | A1 * | 1/2020 | Nishida | G10H 1/346 |
| 2020/0211519 | A1 * | 7/2020 | Komatsu | G10H 1/346 |
| 2020/0243056 | A1 * | 7/2020 | Oba | G10H 1/053 |
| 2020/0243057 | A1 * | 7/2020 | Oba | G10H 7/02 |

FOREIGN PATENT DOCUMENTS

| | | | |
|---|---|---|---|
| JP | H11175065 | A | 7/1999 |
| JP | 3149452 | B2 | 3/2001 |
| JP | 2007322871 | A | 12/2007 |
| JP | 2010072417 | A | 4/2010 |
| JP | 2014059534 | A | 4/2014 |

OTHER PUBLICATIONS

Written Opinion issued in Intl. Appln. No. PCT/JP2018/010043 dated Jun. 5, 2018.
International Search Report issued in Intl. Appln No. PCT/JP2018/010044 dated May 29, 2018. English translation provided.
Written Opinion issued in Intl. Appln. No. PCT/JP2018/010044 dated May 29, 2018.
Copending U.S. Appl. No. 16/568,880, filed Sep. 12, 2019 (a copy is not included because the cited application is not yet available to the public and the Examiner has ready access to the cited application).
English translation of Written Opinion issued in Intl. Appln. No. PCT/JP2018/010044 dated May 29, 2018, previously cited in IDS filed Sep. 12, 2019.
English translation of Written Opinion issued in Intl. Appln. No. PCT/JP2018/010043 dated Jun. 5, 2018, previously cited in IDS filed Sep. 12, 2019.
Office Action issued in Japanese Appln. No. 2019-506233 dated Sep. 29, 2020. English machine translation provided.
Office Action issued in Japanese Appln. No. 2019-506232 dated Sep. 29, 2020. English machine translation provided.
Office Action issued in U.S. Appl. No. 16/568,880 dated Jul. 9, 2020.

* cited by examiner

SIGNAL SUPPLY DEVICE, KEYBOARD DEVICE AND NON-TRANSITORY COMPUTER-READABLE STORAGE MEDIUM

CROSS-REFERENCE TO RELATED APPLICATIONS

This application is a U.S. continuation application filed under 35 U.S.C. § 111(a), of International Application No. PCT/JP2018/010043, filed on Mar. 14, 2018, which claims priority to Japanese Patent Application No. 2017-050144, filed on Mar. 15, 2017, the disclosures of which are incorporated by reference.

FIELD

This invention relates to a technology for supplying a sound signal representing a sound produced by an acoustic musical instrument.

BACKGROUND

Conventionally, there has been known an electronic keyboard musical instrument that controls the intensity of a produced sound according to the key depressing velocity. However, whereas a quick and soft depression of a key on an acoustic piano produces a soft sound, a quick depression of a key on a conventional electronic keyboard musical instrument is recognized as a hard depression. This causes a sound to be produced as if the key had been hard depressed, and conversely, a slow and hard depression of the key is recognized as a soft depression of the key, with the result that a soft sound is produced. Further, an acoustic piano has a wooden keybed placed below the keyboard, and a depression of a key causes a sound to be produced by a collision between the key and the keybed (such a sound being hereinafter referred to as "keybed hitting sound"). The keybed hitting sound affects the production of a sound by playing. However, a conventional electronic keyboard musical instrument has not produced a keybed hitting sound. Japanese Patent No. 3149452 proposes an electronic musical instrument that can reproduce a keybed hitting sound.

SUMMARY

According to an embodiment of the present invention, there is provided a signal supply device comprising a generator configured to generate a first sound signal and a second sound signal in accordance with an instruction signal including operation body information corresponding to an operation input to an operation body and linked member information corresponding to a movement of a linked member linked with the operation body and an adjuster configured to adjust a relationship between the first sound signal and the second sound signal on the basis of the operation body information and the linked member information.

According to an embodiment of the present invention, there is provided a keyboard device comprising the signal supply device described above, a plurality of keys each serving as the operation body, and a plurality of hammers each serving as the linked member.

According to an embodiment of the present invention, there is provided a non-transitory computer-readable storage medium having stored thereon a program for causing a computer to execute operations including generating a first sound signal and a second sound signal in accordance with an instruction signal containing operation body information corresponding to an operation input to an operation body and linked member information corresponding to a movement of a linked member linked with the operation body and adjusting a relationship between the first sound signal and the second sound signal on the basis of the operation body information and the linked member information.

DESCRIPTION OF EMBODIMENTS

In the case of an acoustic piano, relative sound production timings and sound volumes of string striking sounds and keybed hitting sounds vary according to how the keys are depressed. However, the technology disclosed in Japanese Patent No. 3149452 has been unable to reproduce such sound production.

According to the present invention, which will be described below, a relationship between a plurality of sounds, such as string striking sounds and keybed hitting sounds of an acoustic piano, that are produced by an operation on operation bodies such as keys can vary according to the operation.

First, relationships between a keybed hitting sound and a sound produced by a hammer striking a string (such a sound being hereinafter referred to as "string striking sound") on an acoustic piano are described.

Figure 13:
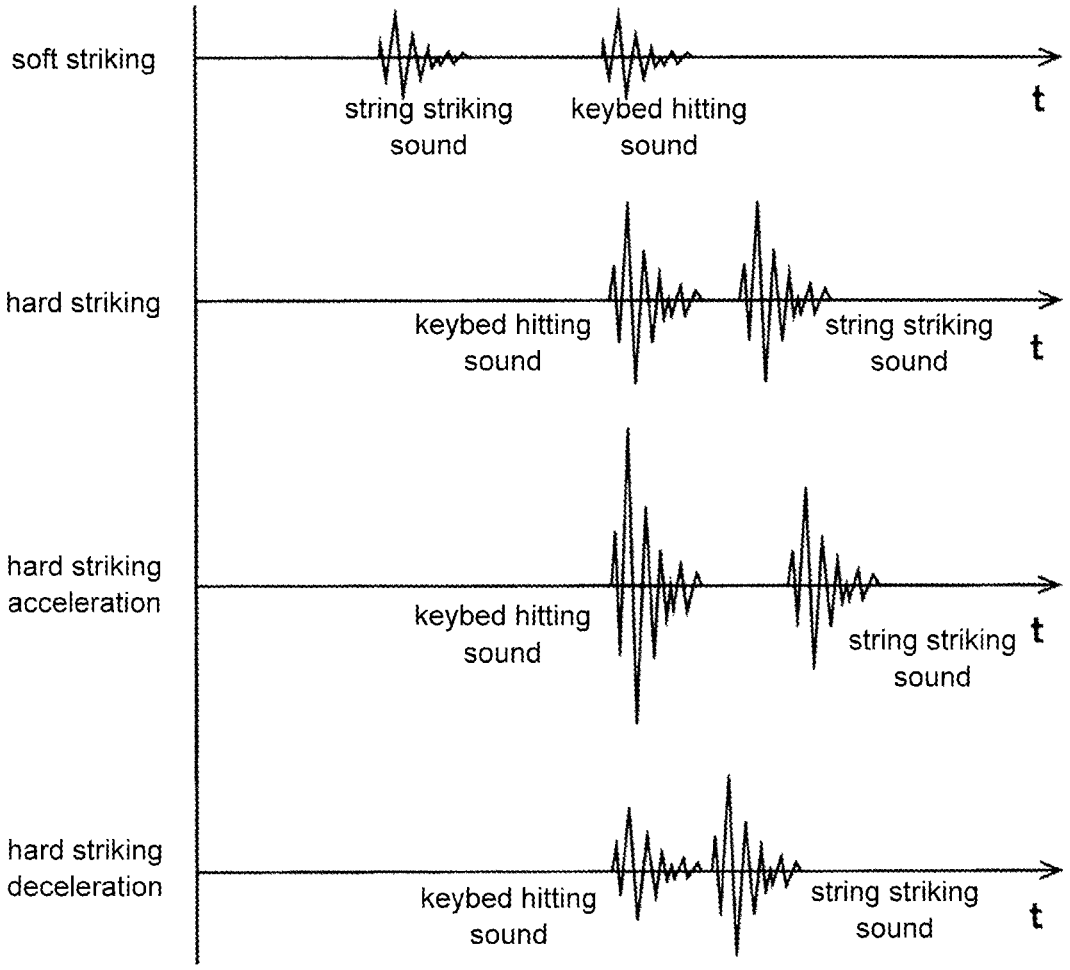
FIG. 13 is a diagram showing relationships between a keybed hitting sound and a string striking sound in relation to sound production timings and sound volumes.

FIG. 13 is a diagram showing relationships between a keybed hitting sound and a string striking sound in relation to sound production timings and sound volumes. In FIG. 13, the legends "SOFT STRIKING" and "HARD STRIKING" represent the intensity of a depression of a key at a certain acceleration Aa. The waveforms of a string striking sound and a keybed hitting sound that are shown in correspondence with the intensity of a depression of a key indicate a relationship between sound volumes and production timings. With reference to the production timing of the keybed hitting sound, a string striking sound precedes a keybed hitting sound in the case of "SOFT STRIKING" and a string striking sound follows a keybed hitting sound in the case of "HARD STRIKING".

In FIG. 13, the legend "HARD STRIKING ACCELERATION" represents a depression of a key at a higher acceleration Ab than Aa in the case of "HARD STRIKING". Meanwhile, the legend "HARD STRIKING DECELERATION" represents a depression of a key at a lower acceleration Ac than Aa. As can be seen from waveforms that are shown in correspondence with the intensity if a depression of a key, "HARD STRIKING ACCELERATION" produces a louder keybed hitting sound and produces a string striking sound at a later timing than "HARD STRIKING". "HARD STRIKING DECELERATION" produces a smaller keybed hitting sound and produces a string striking sound at an earlier timing than "HARD STRIKING".

That is, as shown in FIG. 13, in the case of "SOFT STRIKING", a keybed hitting sound is produced after a string striking sound. Meanwhile, in the cases of "HARD STRIKING", "HARD STRIKING ACCELERATION", and "HARD STRIKING DECELERATION", a string striking sound is produced after a keybed hitting sound. Further, as shown in "HARD STRIKING", "HARD STRIKING ACCELERATION", and "HARD STRIKING DECELERATION", the sound volumes of keybed hitting sounds may vary even in the case of a constant string striking sound volume. It should be noted that although FIG. 13 shows only the cases of "HARD STRIKING" as examples with varied accelerations, relationships between a string striking sound and a keybed hitting sound also vary in the same manner according to acceleration in cases of "SOFT STRIKING". It should be noted that depending on the intensity of a depression of a key, a relative order in production timings between a string striking sound and a keybed hitting sound may be changed or may not be changed by the key depressing acceleration.

In this way, when an acoustic piano is played, relationships in production timing and relationships in sound volume relatively vary in relation to string striking sounds and keybed hitting sounds. This variation may be utilized to attain performance expression. However, a conventional electronic keyboard musical instrument has been unable to adjust such a relationship between a string striking sound and a keybed hitting sound.

In the following, an electronic keyboard musical instrument provided with a signal supply device according to an embodiment of the present invention is described with reference to the drawings. Embodiments to be described below are examples of embodiments of the present invention, and the present invention is not construed within the limitations of these embodiments.

First Embodiment

A signal supply device according to a first embodiment of the present invention is described with reference to the drawings. Each of the embodiments to be described below is described by taking, as an example, an electronic keyboard musical instrument (keyboard device) provided with a signal supply device of one embodiment of the present invention.

[Structure Associated with White Key]

Although an electronic keyboard musical instrument provided with a signal supply device of according to the present embodiment is provided with a plurality of white keys and black keys, a description is given here by taking the structure of a white key as an example.

Figure 1:
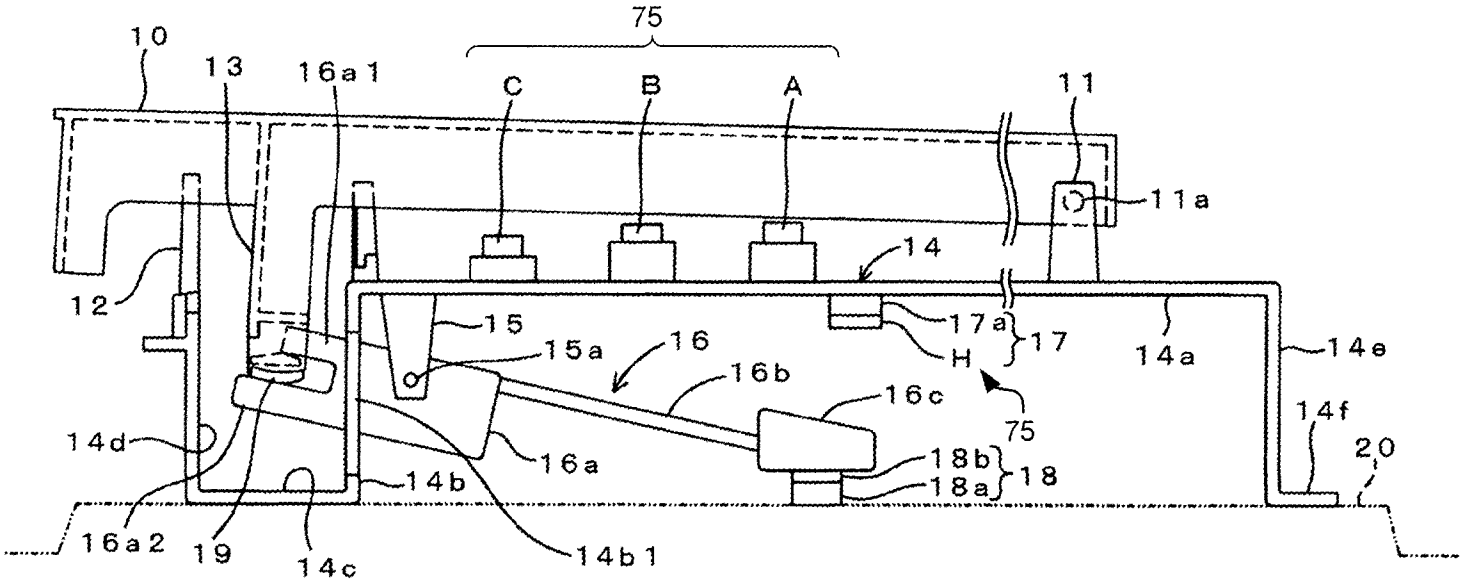
FIG. 1 is a diagram schematically showing a structure associated with a white key provided on an electronic keyboard musical instrument according to a first embodiment.

FIG. 1 is a diagram schematically showing a structure associated with a white key 10 provided on an electronic keyboard musical instrument according to the first embodiment. FIG. 1 shows the front of the electronic keyboard musical instrument on the left hand thereof and the back of the electronic keyboard musical instrument on the right hand thereof. As shown in FIG. 1, the white key 10 is placed above a key frame 14. The key frame 14 includes a top plate part 14*a*, a front plate part 14*b*, a bottom plate part 14*c*, a front plate part 14*d*, a back plate part 14*e*, and a bottom plate part 14*f*. The top plate part 14*a* extends in a front-back direction and a right-left direction. The front plate part 14*b* extends vertically downward from a front end of the top plate part 14*a*. The bottom plate part 14*c* extends horizontally forward from a lower end of the front plate part 14*b*. The front plate part 14*d* extends vertically upward from a front end of the bottom plate part 14*c*. The back plate part 14*e* extends vertically downward from a back end of the top plate part 14*a*. The bottom plate part 14*f* extends horizontally backward from a lower end of the back plate part 14*e*. The key frame 14 is fixed on an upper surface of a frame 20.

A key supporting member 11 is formed to protrude from an upper surface of the top plate part 14*a* that is closer to the back end. The white key 10 has its back end swingably pivoted on the key supporting member 11 via a shaft member 11*a*. A key guide 12 for guiding a swing of the white key 10 is formed to protrude from an upper end face of the front plate part 14*d*. The key guide 12 is inserted in the white key 10 from below. A driver 13 extends downward from a lower surface of the white key 10 that is closer to a front end of the white key 10. The driver 13 has a front wall extending upward and downward and side walls extending backward from right and left ends, respectively, of the front wall. The driver 13 is formed by the front wall and the side walls into a hollow that is open backward. The driver 13 has its lower end closed by a lower end wall. Attached to a lower end of the lower end wall is a cushioning member 19.

A hammer 16 is placed in a site below the top plate part 14*a* that faces the white key 10. The hammer 16 includes a base portion 16*a*, a coupling rod 16*b*, and a mass body 16*c*. A hammer supporter 15 is formed to protrude downward from a lower surface of the top plate part 14*a* that is closer to the front end. On the hammer supporter 15, the base part 16*a* of the hammer 16 is swingably pivoted via a shaft member 15*a*. The base part 16*a* has a pair of upper and lower legs 16*a*1 and 16*a*2 provided at a front end portion thereof. The upper leg 16*a*1 is formed to be shorter than the lower leg 16*a*2. The front plate part 14*b* has an opening 14*b*1 formed in the shape of a vertically long slit. The front end portion of the base part 16*a* protrudes farther forward than the front plate part 14*b* though the opening 14*b*1. The lower end wall of the driver 13 and the cushioning member 19 are inserted between the legs 16*a*1 and 16*a*2. The cushioning member 19 is in contact with an upper surface of the leg 16*a*2. The coupling rod 16*b* has its front end attached to an upper portion of a back end of the base part 16*a*. The mass body 16*c* is attached to a back end of the coupling rod 16*b*.

In this embodiment, the base part 16*a* is made of synthetic resin, and the coupling rod 16*b* and the mass body 16*c* are each made of metal. Further, the cushioning member 19 is made of a shock absorber such as rubber, urethane, or felt.

Further, an upper limit stopper 18 is provided in a site on an upper surface of the frame 20 that faces the mass body 16*c*. The upper limit stopper 18 regulates the upward displacement of the front end portion of the white key 10 during key releasing by making contact with a lower surface of the mass body 16*c* and regulating the downward displacement of the rear end portion of the hammer 16. The upper limit stopper 18 includes a stopper rail 18*a* and a cushioning material 18*b*. The stopper rail 18*a* protrudes from the upper surface of the frame 20 and extends in a right-left direction.

In this embodiment, the cushioning material 18*b* is made of a shock absorber such as rubber or felt.

A detector 75 is provided in a site on the upper surface of the top plate part 14*a* that faces a bottom surface of the white key 10. The detector 75 includes switches A to C and an after-mentioned pressure sensor H. The switch A, the switch B and the switch C are arranged at predetermined interval from each other in sequence from the back. That is, the switches A to C are provided to detect the white key 10 in a plurality of different positions within a range of movement of the white key 10. The switches A to C are each a push-on pressure-sensitive switch, and in the process of depressing the white key 10 to the lower limit, the switch A, the switch B and the switch C become turned on in sequence. Actuating signals from the switches A to C are used to compute the key depressing acceleration (operation body information), and on the basis of a result of the computation, the production timings and sound volumes of a string striking sound and a keybed hitting sound are determined.

A lower limit stopper 17 is provided on a back surface of the top plate part 14*a* of the key frame 14. The lower limit stopper 17 regulates the downward displacement of a front end portion of the white key 10 by making contact with an upper surface of the mass body 16*c* of the hammer 16 when the key is depressed and regulating the upward displacement of a rear end portion of the hammer 16. The lower limit stopper 17 includes a stopper rail 17*a* and a pressure sensor H firmly attached to a lower end face of the stopper rail 17*a*. When the key 10 is depressed, the mass body 16*c* rises and the upper surface of the mass body 16*c* collides with the pressure sensor H, so that the pressure sensor H outputs a signal corresponding to the pressure caused by the collision. This signal is an electrical signal having a voltage corresponding to the pressure caused by the collision of the mass body 16*c*, and is a signal that is obtained in correspondence with the moving velocity of a hammer 16 (linked member) linked with the key 10. In this example, information proportional to the moving velocity of the hammer 16 is obtained from the output signal from the pressure sensor H. In this embodiment, the pressure sensor H is a piezoelectric element.

[Configuration of Electronic Keyboard Musical Instrument]

Next, a configuration of an electronic keyboard musical instrument is described with reference to FIG. 2, which is a block diagram thereof. It should be noted that the white keys 10 and the black keys are collectively referred to as "key (operation body)".

Figure 2:
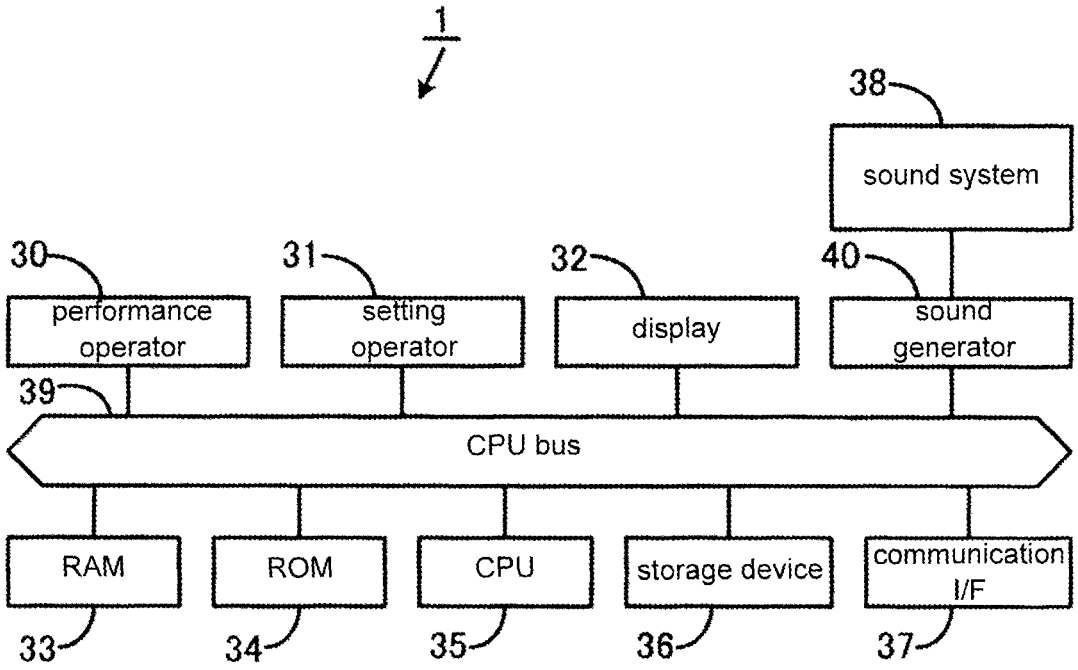
FIG. 2 is a block diagram showing a configuration of an electronic keyboard musical instrument according to the first embodiment.

FIG. 2 is a block diagram showing a configuration of an electronic keyboard musical instrument 1 according to the first embodiment. The electronic keyboard musical instrument 1 includes a CPU 35 that controls the operation of the electronic keyboard musical instrument 1. A RAM 33, a ROM 34, a storage device 36, a communication interface (described as "COMMUNICATION I/F" in FIG. 2) 37, a performance operator 30, a setting operator 31, a display 32, and a sound generator 40 are electrically connected to the CPU 35 via a CPU bus (data bus and address bus) 39. The sound generator 40 is electrically connected to a sound system 38. The CPU 35 and the sound generator 40 function as a signal supply device that supplies a signal to the sound system 38.

The ROM 34 has readably stored thereon various types of computer program that the CPU 35 executes, various types of table data to which the CPU 35 refers in executing a predetermined computer program, and the like. The RAM 33 is used as a working memory which temporarily stores various types of data that are generated when the CPU 35 executes a predetermined computer program and the like. Alternatively, the RAM 33 is used as a memory or the like which temporarily stores a currently executed computer program and data associated with the computer program. The storage device 36 has stored therein various types of application programs, various types of data associated with the various types of application programs, and the like.

The performance operator 30 includes switches A to C, a pressure sensor H, and the like provided in correspondence with each key. The setting operator 31 includes operators, such as a volume dial, that configure various types of setting. The display 32 includes a liquid crystal display (LCD), an organic EL display, or the like and displays the state of control of the electronic keyboard musical instrument 1, the contents of setting and control by the setting operator 31, and the like. The sound system 38 includes a D/A converter that converts a digital signal outputted from the sound generator 40 into an analog signal, an amplifier that amplifies a signal output from the D/A converter, a speaker that emits as a sound a signal output from the amplifier. The communication interface 37 is an interface for transmitting and receiving a control program, various types of data associated with the control program, event information corresponding to a performance operation, and the like between the electronic keyboard musical instrument 1 and an external device (not illustrated; e.g. a server, a MIDI device, or the like). The communication interface 37 may be an interface such as a MIDI interface, a LAN, the Internet, or a telephone line. Further, the communication interface 37 may be a wired interface or a wireless interface.

[Configuration of Sound Generator]

Figure 3:
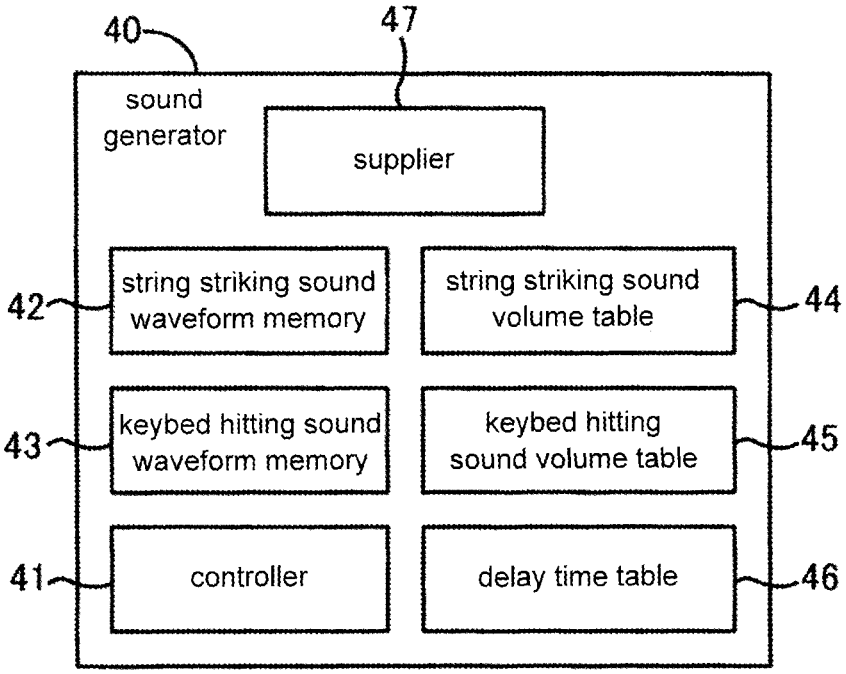
FIG. 3 is a block diagram showing a configuration of a sound generator.

A configuration of the sound generator 40 is described here with reference to FIG. 3. It should be noted that the sound generator 40 exercises sound production control in accordance with instruction signals (such as note-on, note-off, hammer velocity VH, and key depressing acceleration $\alpha$) from the CPU 35.

FIG. 3 is a block diagram showing a configuration of the sound generator 40. As shown in FIG. 3, the sound generator 40 includes a controller 41, a string striking sound waveform memory 42, a keybed hitting sound waveform memory 43, a string striking sound volume table 44, a keybed hitting sound volume table 45, a delay time table 46, and a supplier 47. The string striking sound waveform memory 42 has stored therein string striking sound waveform data obtained by sampling the string striking sounds of the keys of an acoustic piano. Accordingly, the string striking sound waveform data is data for generating a signal (first sound signal) representing a string striking sound. Each piece of string striking sound waveform data represents the pitch and tone of a string striking sound and is associated with a corresponding one of the keys of the electronic keyboard musical instrument 1. The keybed hitting sound waveform memory 43 has stored therein keybed hitting sound waveform data obtained by sampling keybed hitting sounds generated by depressing the keys of an acoustic piano. Accordingly, the keybed hitting sound waveform data is a data for generating a signal (second sound signal) representing a keybed hitting sound. Each piece of keybed hitting sound waveform data represents the pitch and tone of a keybed hitting sound and is associated with a corresponding one of the keys of the electronic keyboard musical instrument 1. In the following description, a signal representing a string striking sound and a signal representing a keybed hitting sound may be simply referred to as "string striking sound" and "keybed hitting sound", respectively.

It should be noted that there may be no variations in the pitches of keybed hitting sounds from one key to another or the pitches of keybed hitting sounds may vary less than the pitches of string striking sounds. That is, whereas there are variations in the pitches of string striking sounds between a case where a first key is operated and a case where a second key is operated, there may be no variations in the pitches of keybed hitting sounds or the pitches of keybed hitting sounds may vary with smaller pitch differences than the pitches of string striking sounds.

Figure 4A:
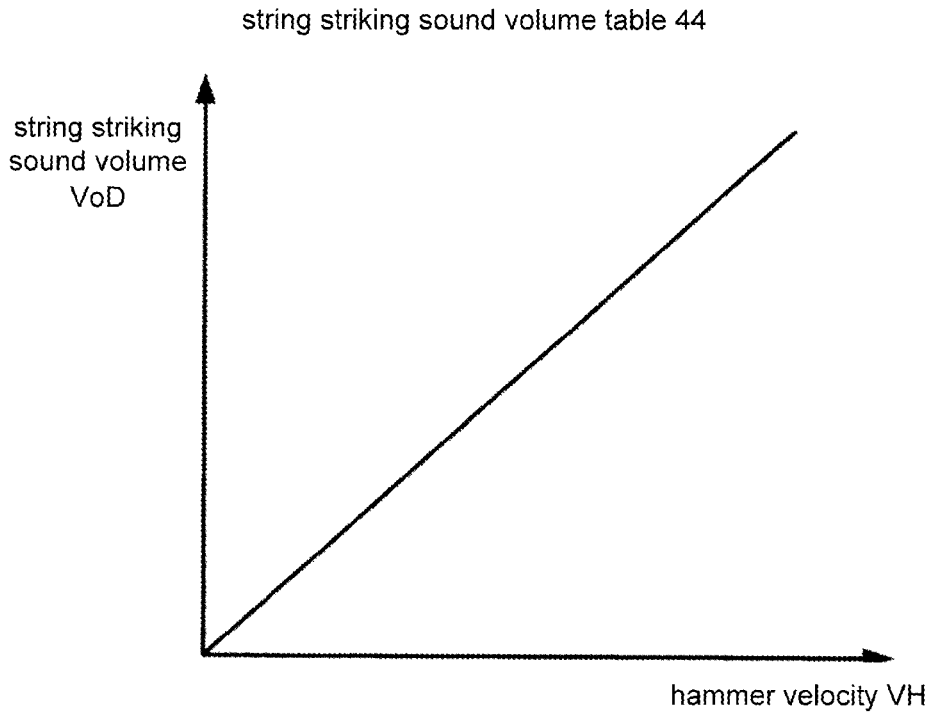
FIG. 4A is a diagram showing a configuration of a string striking sound volume table.
Figure 4B:
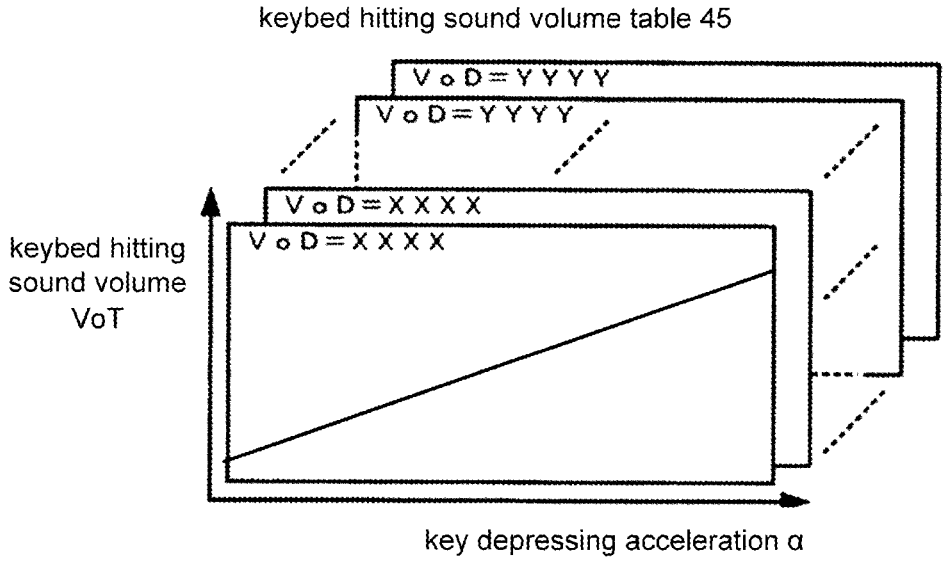
FIG. 4B is a diagram showing a configuration of a keybed hitting sound volume table.

FIG. 4A is a diagram showing a configuration of the string striking sound volume table 44, FIG. 4B is a diagram showing a configuration of the keybed hitting sound volume table 45. The string striking sound volume table 44 is a table for determining the sound volume of a string striking sound generated by depressing a key (such a sound volume being hereinafter referred to as "string striking sound volume"). As shown in FIG. 4A, the string striking sound volume table 44 defines a correspondence relationship between the string striking sound volume VoD and the velocity of the hammer 16 during a key depression (such a velocity being hereinafter referred to as "hammer velocity") VH. The hammer velocity VH (linked member information) is computed by the CPU 35 on the basis of the voltage of a signal that is output from the pressure sensor H (FIG. 2). As shown in FIG. 4A, the hammer velocity VH and the string striking sound volume VoD are in proportion to each other, and an increase in hammer velocity VH leads to an increase in string striking sound volume VoD. Further, the string striking sound volume table 44 is not limited to the form shown in FIG. 4A but may be in any desired form. For example, the string striking sound volume table 44 may not be in a table form but be calculated by an arithmetic expression.

The keybed hitting sound volume table 45 is a table for determining the sound volume of a keybed hitting sound generated by depressing a key (such a sound volume being hereinafter referred to as "keybed hitting sound volume"). As shown in FIG. 4B, the keybed hitting sound volume table 45 defines a correspondence relationship between the keybed hitting sound volume VoT and the acceleration of the key being depressed (such an acceleration being hereinafter referred to as "key depressing acceleration") $\alpha$ with respect to each value of the string striking sound volume VoD. The key depressing acceleration $\alpha$ is computed by the CPU 35 (FIG. 2) on the basis of a time difference $\Delta t$ between the time tAB from the turning on of the switch A (FIG. 1) to the turning on of the switch B and a time tBC from the turning on of the switch B to the turning on of the switch C. FIG. 4B shows a table of a predetermined VoD value XXXX. The key depressing acceleration $\alpha$ and the keybed hitting sound volume VoT are in proportion to each other, and an increase in key depressing acceleration $\alpha$ leads to an increase in keybed hitting sound volume VoT. Such a relationship between the key depressing acceleration $\alpha$ and the keybed hitting sound volume VoT is provided for the value of each string striking sound volume VoD. Further, the keybed hitting sound volume table 45 is not limited to such a form but may be in any desired form. For example, the keybed hitting sound volume table 45 may be defined by a table whose vertical and horizontal axes represent the VoD value and the key depressing acceleration $\alpha$, respectively, and that defines a keybed hitting sound volume VoT in each cell. In this case, a corresponding keybed hitting sound volume VoT is calculated from a detected VoD value and the key depressing acceleration $\alpha$. Further, the keybed hitting sound volume table 45 may not be in a table form but be calculated by an arithmetic expression.

Figure 5:
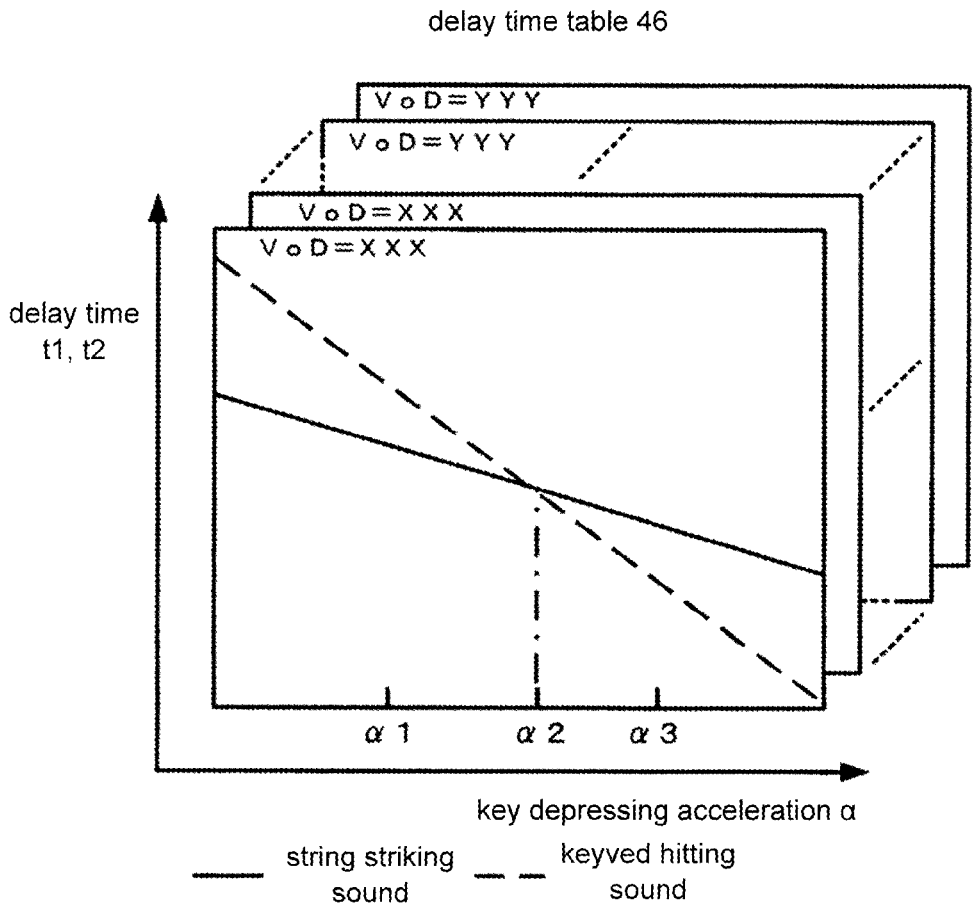
FIG. 5 is a diagram showing a configuration of a delay time table.

FIG. 5 is a diagram showing a configuration of the delay time table 46. The delay time table 46 is a table for determining the production timings of a string striking sound and a keybed hitting sound. As shown in FIG. 5, the delay time table 46 defines a correspondence relationship between a delay time t1 of a string striking sound, a delay time t2 of a keybed hitting sound, and the key depressing acceleration $\alpha$ with respect to each value of the string striking sound volume VoD. Assume that $\alpha 2$ is the key depressing acceleration at which the production timings of a string striking sound and a keybed hitting sound are identical (t1=t2). Then, at the key depressing acceleration $\alpha 1$, which is lower than the key depressing acceleration $\alpha 2$, i.e. at the time of "HARD STRIKING DECELERATION" and "SOFT STRIKING DECELERATION", at which deceleration (negative acceleration) takes place, the string striking sound is produced at an earlier timing than the keybed hitting sound. At the key depressing acceleration $\alpha 3$, which is higher than the key depressing acceleration $\alpha 2$, i.e. at the time of "HARD STRIKING ACCELERATION" and "SOFT STRIKING ACCELERATION", at which acceleration takes place, the settings are configured such that the keybed hitting sound is produced at an earlier timing than the string striking sound (FIG. 13).

Although a case has been illustrated here where the key depressing acceleration $\alpha 2$, at which the delay time t1=t2, is "0", the key depressing acceleration $\alpha 2$ does not necessarily need to be "0". In this case, such a relationship may not hold that $\alpha 1$ takes on a negative value and $\alpha 3$ takes on a positive value. Further, this relationship may vary depending on the string striking sound volume VoD value, or there may exist no key depressing acceleration at which the delay time t1=t2. That is, for all key depressing accelerations, there may be cases where t1>t2, or there may be cases where t1<t2. It should be noted that the delay time table 46 is not limited to such a form but may be in any desired form. For example, the delay time table 46 may be defined by a table whose vertical and horizontal axes represent the VoD value and the key depressing acceleration $\alpha$, respectively, and that defines the values of the amounts of delay time t1 and t2 in each cell. In this case, the respective amounts of delay of a corresponding string striking sound and a corresponding keybed hitting sound are calculated from a detected VoD value and the key depressing acceleration $\alpha$.

It should be noted that although the keybed hitting sound volume table 45 defines a relationship between the key depressing acceleration $\alpha$ and the keybed hitting sound volume VoT for each value of the string striking sound volume VoD, the keybed hitting sound volume table 45 may alternatively define a relationship between the key depressing acceleration $\alpha$ and the keybed hitting sound volume VoT for each value of a velocity value instead of the string striking sound volume VoD. Further, although the delay time table 46 defines a relationship between the key depressing acceleration α and the delay times t1 and t2 for each value of the string striking sound volume VoD, the delay time table 46 may alternatively define a relationship between the key depressing acceleration α and the delay times t1 and t2 for each value of the velocity value instead of the string striking sound volume VoD. Thus, the delay time table 46 and the keybed hitting sound volume table 45 are structured in this manner so that values of sound volumes and timings vary depending on acceleration even in the case of a constant string striking sound volume.

The controller 41 (FIG. 3) determines the string striking sound volume VoD on the basis of the hammer velocity VH computed by the CPU 35 (FIG. 2) and determines the keybed hitting sound volume VoT and the delay times t1 and t2 of the production timings of a string striking sound and a keybed hitting sound on the basis of the key depressing acceleration α. Further, the controller 41 reads out the string striking sound waveform data corresponding to a depressed key from the string striking sound waveform memory 42 and reads out the keybed hitting sound waveform data from the keybed hitting sound waveform memory 43, and outputs each piece of waveform data to the sound system 38 at the delay times t1 and t2 thus determined. That is, the controller 41 functions as a generator that generates a string striking sound signal from string striking sound waveform data output from the string striking sound waveform memory 42 and generates a keybed hitting sound signal from keybed hitting sound waveform data output from the keybed hitting sound waveform memory 43. Further, the controller 41 functions as an adjuster that adjusts a relationship between a string striking sound signal and a keybed hitting sound signal and, in this example, modes of generation such as the sound volumes (output levels) and production timings of these signals. It should be noted that some or all of the functions, such as the adjuster that are achieved by the controller 41 may be achieved by the CPU 35 executing a computer program.

The suppliers 47 outputs string striking sound waveform data and keybed hitting sound waveform data whose modes of generation have been adjusted by the controller 41 and supplies them to the sound system 38.

[Sound Production Control]

Next, the sound production control of a string striking sound and a keybed hitting sound by the CPU 35 and the controller 41 is described with reference to the drawings.

Figure 6:
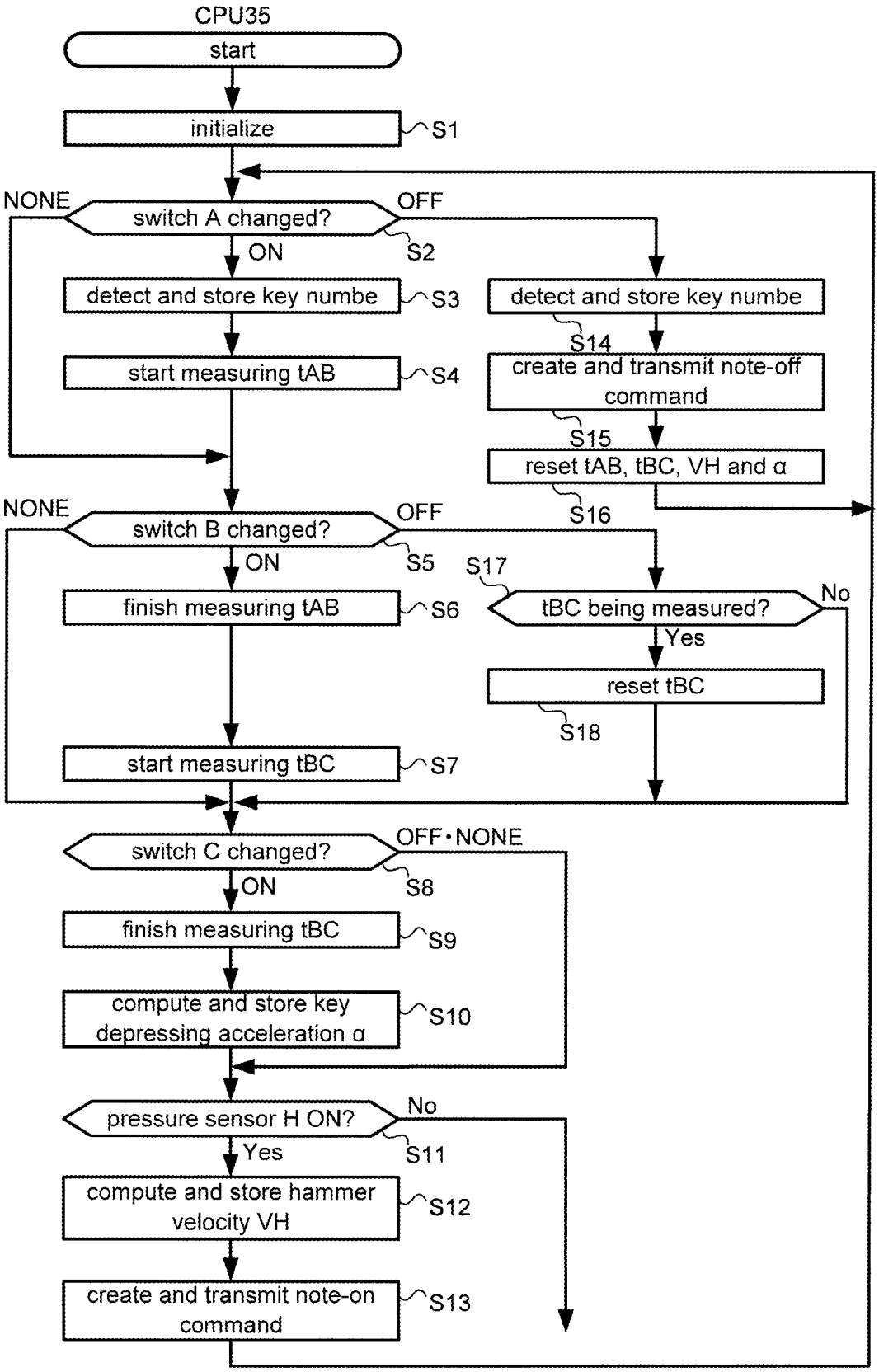
FIG. 6 is a flow chart showing a process that a CPU executes.
Figure 7:
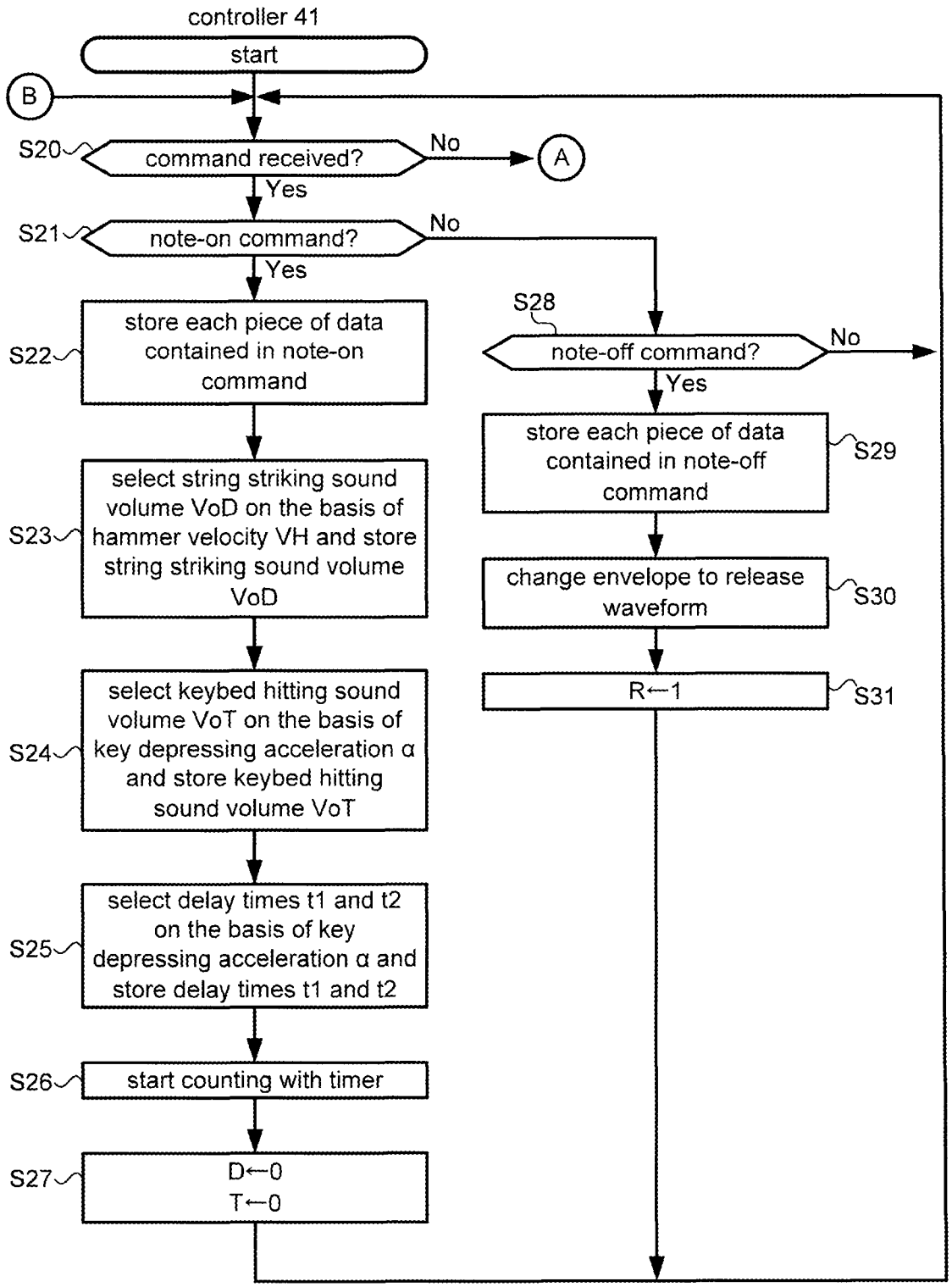
FIG. 7 is a flow chart showing the flow of a process that a controller executes.
Figure 8:
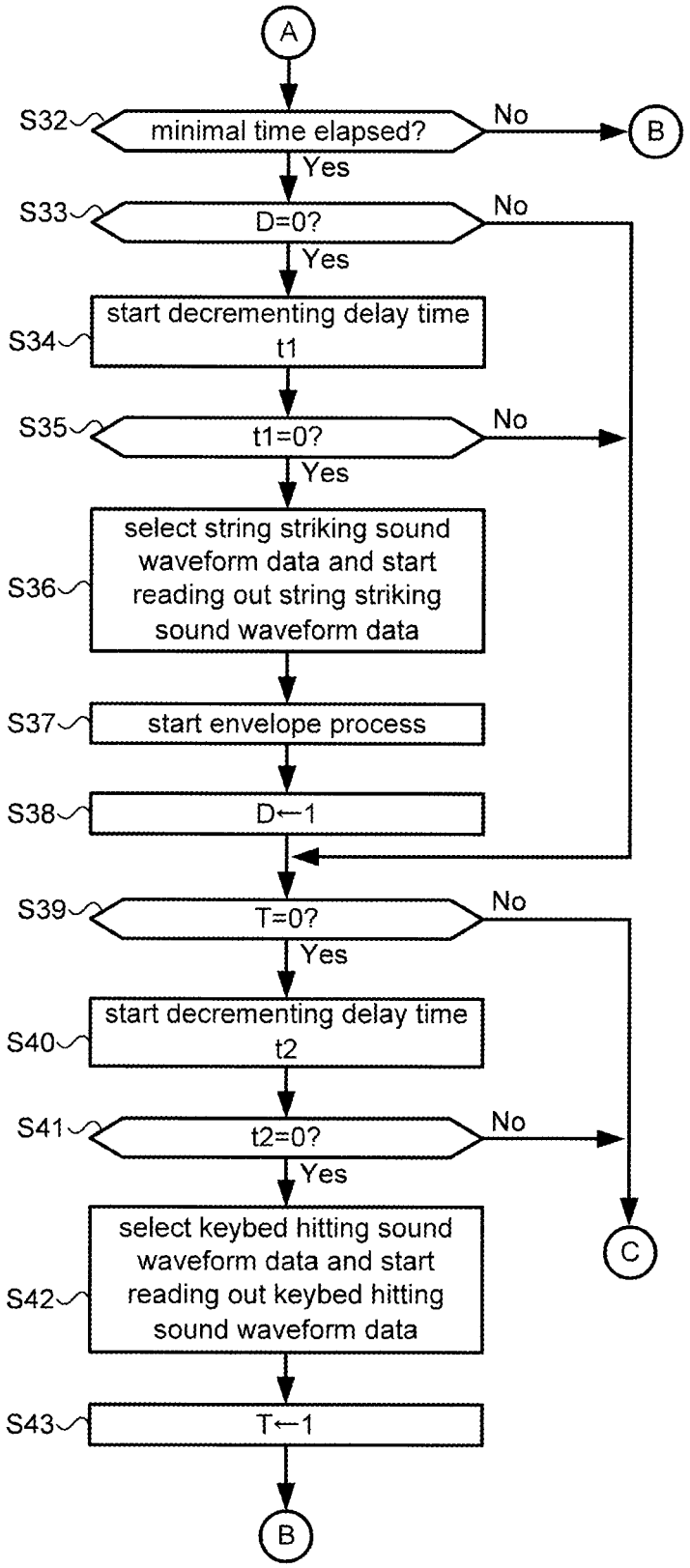
FIG. 8 is a flow chart showing a process that follows the process shown in FIG. 7.
Figure 9:
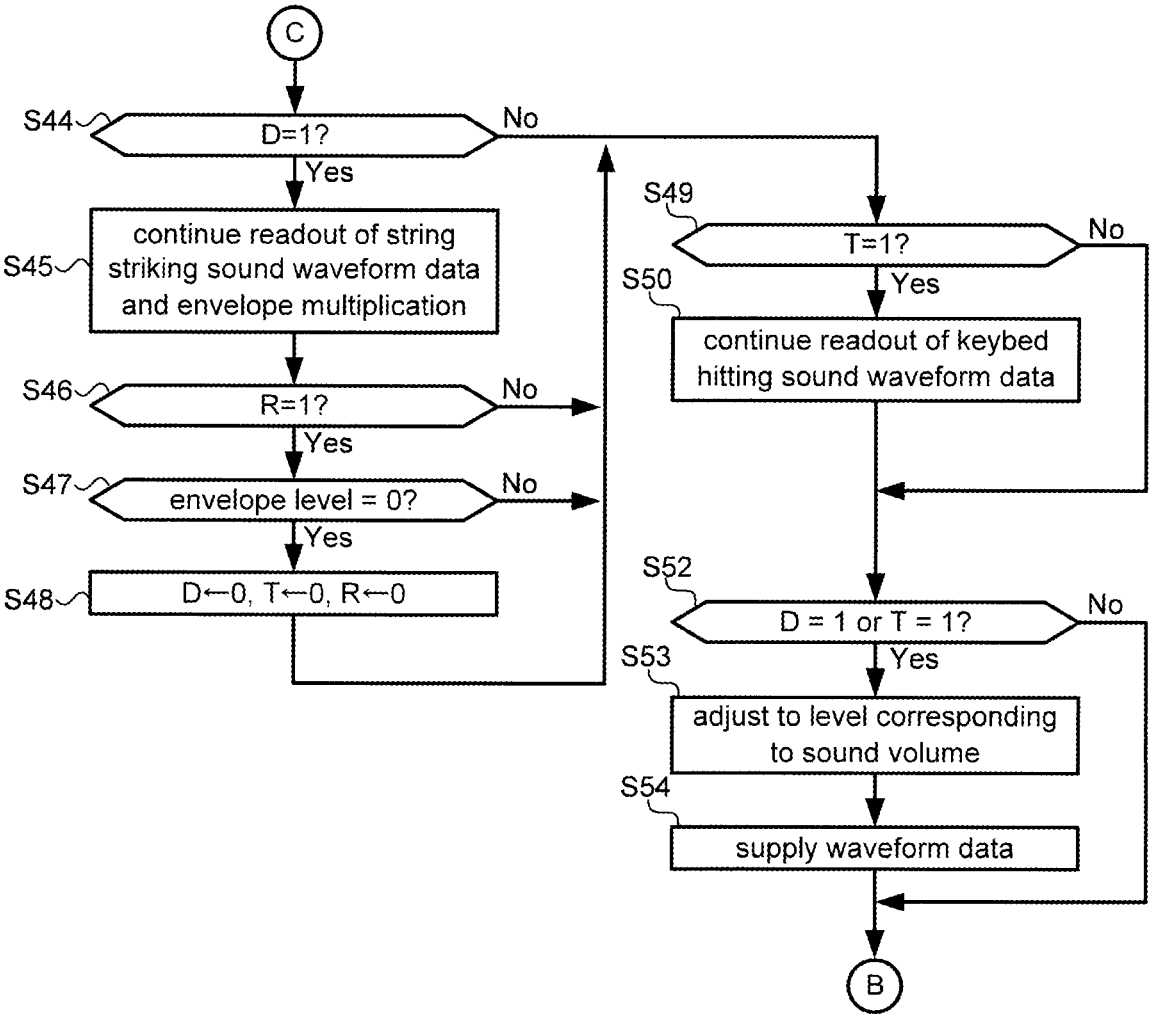
FIG. 9 is a flow chart showing a process that follows the process shown in FIG. 8.

FIG. 6 is a flow chart showing a process that the CPU 35 executes. FIG. 7 is a flow chart showing the flow of a process that the controller 41 executes. FIG. 8 is a flow chart showing a process that follows the process shown in FIG. 7. FIG. 9 is a flow chart showing a process that follows the process shown in FIG. 8. It should be noted that these processes are executed in correspondence with each key.

(Control by CPU 35)

As shown in FIG. 6, the CPU 35 performs initialization such as the resetting of various types of register and flag stored in the RAM 33 (FIG. 2) and the setting of initial values (step (hereinafter abbreviated as "S") 1). Further, in S1, the sound generator 40 is instructed to initialize various types of register and flags. Then, the CPU 35 determines whether a key depressing operation has effected a change in the turning on or turning off of the switch A (FIG. 1) and, in a case where there has been a change, determines whether the switch A has been turned on or turned off (S2). In a case where there is no change in the turning on or turning off of the switch A (S2; NONE), the process proceeds to S5. In a case where the CPU 35 has determined that the switch A has changed from being off to being on (S2; ON), the CPU 35 detects the key number of a key corresponding to the switch A thus turned on and stores the key number thus detected in a register (S3). Then, the CPU 35 starts measuring the time tAB from the turning on of the switch A to the turning on of the switch B (S4).

Then, the CPU 35 determines whether there has been a change in the turning on or turning off of the switch B and, in a case where there has been a change, determines whether the switch B has been turned on or turned off (S5). In a case where there is no change in the turning on or turning off of the switch B (S5; NONE), the process proceeds to S8. In a case where the CPU 35 has determined that the switch B has changed from being off to being on (S5; ON), the CPU 35 finishes measuring the time tAB (S6).

Then, the CPU 35 starts measuring the time tBC from the turning on of the switch B to the turning on of the switch C (S7). Then, the CPU 35 determines whether there has been a change in the turning on or turning off of the switch C and, in a case where there has been a change, determines whether the switch C has been turned on or turned off (S8). In a case where here is no change in the turning on or turning off of the switch C (S8; NONE) and a case where the switch C has been turned off (S8; OFF), the CPU 35 proceeds with the process to S11. In a case where the CPU 35 has determined that the switch C has changed from being off to being on (S8; ON), the CPU 35 finishes measuring the time tBC (S9). Then, the CPU 35 computes the key depressing acceleration α on the basis of the time difference Δt between the times tAB and tBC thus measured and stores the key depressing acceleration α thus computed in the register (S10). The computation of the key depressing acceleration α may involve the use of a table of correspondence between the time difference Δt and the key depressing acceleration α. It should be noted that the key depressing acceleration α needs only take on a value equivalent to an acceleration that is obtained by predetermined computation as shown here, and is not limited to a case where the key depressing acceleration α agrees with an actual acceleration.

Then, the CPU 35 determines whether the pressure sensor H has been turned on (or reached a predetermined voltage value or higher) (S11), and in a case where the CPU 35 has determined that the pressure sensor H has not been turned on (S11, No), the CPU 35 returns the process to S2. In a case where the CPU 35 has determined that the pressure sensor H has been turned on (S11, Yes), the CPU 35 computes the hammer velocity VH on the basis of a signal output from the pressure sensor H and stores the hammer velocity VH thus computed in the register (S12). The computation of the hammer velocity VH may involve the use of a table of correspondence between the voltage value of a signal that is output from the pressure sensor H and the hammer velocity VH. It should be noted that the hammer velocity VH needs only take on a value equivalent to a velocity that is obtained by such computation as that shown here, and is not limited to a case where the hammer velocity VH agrees with an actual velocity. Then, the CPU 35 creates a note-on command having the key number stored in the register in S3, the key depressing acceleration α stored in the register in S10, and the hammer velocity VH stored in the register in S12 and transmits the note-on command to the controller 41 of the sound generator 40 (S13).

Further, in a case where the CPU 35 has determined in S2 that the switch A has changed from being on to being off (S2; OFF), the CPU 35 detects the key number of a key corresponding to the switch A thus turned off and stores the key number thus detected in the register (S14). The CPU 35 transmits a note-off command having the key number stored in the register to the controller 41 of the sound generator 40 (S15) and resets the times tAB and tBC, hammer velocity VH, and key depressing acceleration α of the corresponding key (S16).

Further, in a case where the CPU 35 has determined in S5 that the switch B has changed from being on to being off (S5; OFF), the CPU 35 proceeds with the process to S8 if the time tBC is not being measured (S17; No) and, if the time tBC is being measured (S17; Yes), proceeds with the process to S9 after having reset the time tBC of the corresponding key (S18).

In this way, the CPU 35 outputs instruction signals such as a note-on command and a note-off command to the sound generator 40 on the basis of a detection result yielded by the detector 75 (switches A to C, and pressure sensor H).

(Adjustment of Modes of Generation by Controller 41)

As shown in FIG. 7, the controller 41 determines whether it has received a command from the CPU 35 (S20), and in a case where the controller 41 has determined that it has received a command (S20; Yes), the controller 41 determines whether the command thus received is a note-on command (S21). In a case where the controller 41 has determined here that the command thus received is a note-on command (S21, Yes), the controller 41 stores, in the register, each piece of data included in the note-on command thus received, i.e. the key number, the key depressing acceleration α, and the hammer velocity VH (S22).

Then, the controller 41 refers to the string striking sound volume table 44 (FIG. 4A) and selects a string striking sound volume VoD associated with the hammer velocity VH stored in the register, and stores the string striking sound volume VoD thus selected in the register (S23). Then, the controller 41 refers to a relationship corresponding to the string striking sound volume VoD selected in S23 from among the relationships between a key depressing acceleration α and a keybed hitting sound volume VoT defined in the keybed hitting sound volume table 45 (FIG. 4B), selects a keybed hitting sound volume VoT associated with the key depressing acceleration α stored in the register, and stores the keybed hitting sound volume VoT thus selected in the register (S24). Then, the controller 41 refers to a relationship corresponding to the string striking sound volume VoD selected in S23 from among the relationships between a key depressing acceleration α and delay times t1 and t2 defined in the delay time table 46 (FIG. 5), selects delay times t1 and t2 associated with the key depressing acceleration α stored in the register, and stores the delay times t1 and t2 thus selected in the register (S25).

Then, the controller 41 starts counting time in order to measure elapsed time for obtaining timings corresponding to the delay times t1 and t2 (S26). Further, the controller 41 resets, to 0, a readout state flag D indicating a state where the string striking sound waveform data is being read out from the string striking sound waveform memory 42 (FIG. 3) and a readout state flag T indicating a state where the keybed hitting sound waveform data is being read out from the keybed hitting sound waveform memory 43 (FIG. 3) (S27) and returns the process to S20.

In a case where the controller 41 has determined in S21 that the command thus received is not a note-on command (S21, No), the controller 41 determines whether the command thus received is a note-off command (S28). In a case where the controller 41 has determined that the command thus received is not a note-off command (S28; No), the controller 41 returns the process to S20. In a case where the controller 41 has determined that the command thus received is a note-off command (S28; Yes), the controller 41 stores, in the register, data such as the key number included in the note-off command (S29). Then, the controller 41 changes an envelope by which to multiply the string striking sound waveform data being generated to a release waveform (S30) and sets a release state flag R indicating a key releasing state to 1 (S31).

Moreover, once the controller 41 determines in the next process cycle that it has not received a command (S20; No), the controller 41 determines whether a minimum unit of time has elapsed (S32 of FIG. 8) and, in a case where the minimum unit of time has not elapsed (S32; No), returns the process to S20. Note here the minimum unit of time is a time of a time clock cycle that is counted by a timer having started counting in S26.

Then, in a case where the controller 41 has determined that the minimum unit of time has elapsed (S32; Yes), the controller 41 determines whether the readout state flag D is 0 (S33). In a case where the controller 41 has determined that the readout state flag D is 0 (S33; Yes), the controller 41 starts decrementing a delay time t1 for determining the production timing of a string striking sound (S34). Then, the controller 41 determines whether the delay time t1 has become 0, i.e. whether the production timing of the string striking sound has come (S35). In a case where the controller 41 has determined that t1 is not 0 (S35; No), the controller 41 proceeds with the process to S39. In a case where the controller 41 has determined that t1 has become 0 (S35; Yes), the controller 41 refers to the string striking sound waveform memory 42 (FIG. 3), selects string striking sound waveform data associated with the key number stored in the register, and starts reading out the string striking sound waveform data (S36). Then, the controller 41 starts an envelope process by which to multiply the string striking sound waveform data thus read out by an envelope waveform (S37). It should be noted that the envelope process is subjected to publicly-known ADSR (Attack, Decay, Sustain, Release) control.

Then, the controller 41 sets the readout state flag D to 1 (S38) and determines whether the readout state flag T is 0 (S39). Note here that in a case where the controller 41 has determined that the readout state flag T is 0 (S39; Yes), the controller 41 starts decrementing a delay time t2 for determining the production timing of a keybed hitting sound (S40). Then, the controller 41 determines whether the delay time t2 has become 0, i.e. whether the production timing of the keybed hitting sound has come (S41). In a case where the controller 41 has determined that t2 is not 0 (S51, No), the controller 41 proceeds with the process to S44. In a case where the controller 41 has determined that t2 has become 0 (S41, Yes), the controller 41 refers to the keybed hitting sound waveform memory 43 (FIG. 3), selects keybed hitting sound waveform data associated with the key number stored in the register, and starts reading out the keybed hitting sound waveform data (S42). Then, the controller 41 sets the readout state flag T to 1 (S43).

Then, once the controller 41 returns the process to S20 (FIG. 7) and determines that it has not received a command (S20; No), the controller 41 proceeds with the process to S32 (FIG. 8). Once the controller 41 determines that a minimal time has elapsed (S32; Yes), the controller 41 determines that the readout state flag D has not been reset to 0 (S33; No), since the readout state flag D has been set to 1 in the foregoing step S38 and proceeds with the process to S39. Then, the controller 41 determines that the readout state flag T has not been reset to 0 (S39; No) since the readout state flag T has been set to 1 in the foregoing step S43 and proceeds with the process to S44 (FIG. 9). Note here that the controller 41 determines whether the readout state flag D has been set to 1 (S44), and once the controller 41 determines that the readout state flag D is not 1 (S44; No), the controller 41 proceeds with the process to S49. Once the controller 41 determines that the readout state flag D is 1 (S44; Yes), the controller 41 continues the readout of the string striking sound waveform data whose readout has been started in the foregoing step S36 and the process of multiplying the string striking sound waveform data by the envelope (S45).

Then, the controller 41 determines whether the release state flag R has been set to 1, i.e. whether a key releasing state has been entered (S46), and in a case where the controller 41 has determined that the release state flag R is not 1 (S46; No), the controller 41 determines whether the readout state flag T has been set to 1 (S49). Note here that in a case where the controller 41 has determined that the readout state flag T is not 1 (S49; No), the controller 41 proceeds with the process to S52. In a case where the controller 41 has determined that the readout state flag T is 1 (S49; Yes), the controller 41 continues the readout of the keybed hitting sound waveform data (S50).

Then, the controller 41 determines whether the readout state flag D or the readout state flag T has been set to 1, i.e. whether at least either the string striking sound waveform data or the keybed hitting sound waveform data is being read out (S52). In a case where the controller 41 has determined that the readout state flags D and T are not 1 (they are both 0) (S52; No), the controller 41 returns the process to S20 of FIG. 7. In a case where the controller 41 has determined that the readout state flag D or T is 1 (S52; Yes), the controller 41 adjusts the levels of the string striking sound waveform data being currently read out and the keybed hitting sound waveform data being currently read out to levels corresponding to the string striking sound volume VoD and the keybed hitting sound volume VoT (S53).

Then, the controller 41 controls the supplier 47 so that the supplier 47 supplies the sound system 38 (FIG. 2) with waveform data with the addition of the string striking sound waveform data and the keybed hitting sound waveform data whose levels have been adjusted (S54) and returns the process to S20 (FIG. 7). The production timings of a string striking sound and a keybed hitting sound included in the addition waveform data generated by this addition have been adjusted according to the delay times t1 and t2 and the output levels thereof have been adjusted according to the string striking sound volume VoD and the keybed hitting sound volume VoT. It should be noted that in a case where either waveform data has not been read out, addition is not substantially performed, but the waveform data having been read out is output.

According to such processes, in a case where the key depressing acceleration α is low, the addition waveform data is data obtained in a state where the delay time t2 of the keybed hitting sound is set to be longer than the delay time t1 of the string striking sound or a state where the time difference is set to be small when the delay time t2 is shorter than the delay time t1, as compared with a case where the key depressing acceleration α is high.

Meanwhile, when the key depressing acceleration α is high in a case in which a key has been depressed with the same intensity as above (the hammer velocity VH being the same), the addition waveform data is data obtained in a state where the delay time t1 of the string striking sound is set to be further longer than the delay time t2 of the keybed hitting sound, as compared with a case where the key depressing acceleration α is low. That is, the hammer velocity VH being the same, the higher the key depressing acceleration α is, the longer the time from the production timing of the keybed hitting sound to the production timing of the string striking sound is. For this reason, as in the example shown in FIG. 13, the sound system 38 can reproduce a higher the key depressing acceleration α (HARD STRIKING ACCELERATION) is a greater delay from the production timing of the keybed hitting sound to the production timing of the string striking sound. Further, even with the same key depressing acceleration α, in a case where the hammer velocity VH is low, since the string striking sound volume VoD and the keybed hitting sound volume VoT are set to be small, the sound system 38 produces a smaller string striking sound and a smaller keybed hitting sound. Furthermore, even with the same string striking sound volume, i.e. even with the same hammer velocity VH, the keybed hitting sound volume VoT varies according to variations in the key depressing acceleration α. As shown in FIG. 13, in the case of "HARD STRIKING ACCELERATION", which is higher in key depressing acceleration α than "HARD STRIKING", the sound volume of a keybed hitting sound is greater than in the case of "HARD STRIKING". Further, in the case of "HARD STRIKING DECELERATION", which is lower in key depressing acceleration α than "HARD STRIKING", the sound volume of a keybed hitting sound is smaller than in the case of "HARD STRIKING".

That is, the controller 41 determines the keybed hitting sound volume VoT and the production timings (delay times t1 and t2) of a string striking sound and a keybed hitting sound according to the key depressing acceleration α. Since a physical phenomenon in an acoustic piano where the string striking sound volume VoD is determined by the hammer velocity VH can be reproduced, the production of sounds according to performance expression on an acoustic piano can be reproduced.

Further, in a case where the controller 41 has determined that the command thus received is not a note-on command (S21 of FIG. 7; No), the controller 41 determines whether the command thus received is a note-off command (S28). In a case where the controller 41 has determined that the command thus received is not a note-off command (S28; No), the controller 41 returns the process to S20. In a case where the controller 41 has determined that the command thus received is a note-off command (S28; Yes), the controller 41 stores, in the register, data such as the key number included in the note-off command (S29). Then, the controller 41 changes, to a release waveform, an envelope by which to multiply the string striking sound waveform data being generated (S30), sets, to 1, a release state flag R indicating a key releasing state (S31), and returns the process to S20.

In a state where the release state flag R is set to 1 in the determination process of S46 (FIG. 9), the controller 41 determines that the release state flag R is 1, i.e. that the key has been released (S46 of FIG. 9; Yes). In this case, the controller 41 determines whether the envelope level has become 0 (S47), and in a case where the controller 41 has determined that the envelope level is not 0 (S47; No), the controller 41 proceeds with the process to S49. In a case where the controller 41 has determined that the envelope level has become 0 (S47; Yes), the controller 41 resets the readout state flag D, the readout state flag T, and the release state flag R to 0 (S48) and proceeds with the process to S49.

[Functional Configuration of Sound Production Control]

In the foregoing, the sound production control has been described as the flow of processes with reference to the flow charts. In the following, the sound production control is described as a functional configuration of the electronic keyboard musical instrument 1 with reference to a block diagram.

Figure 10:
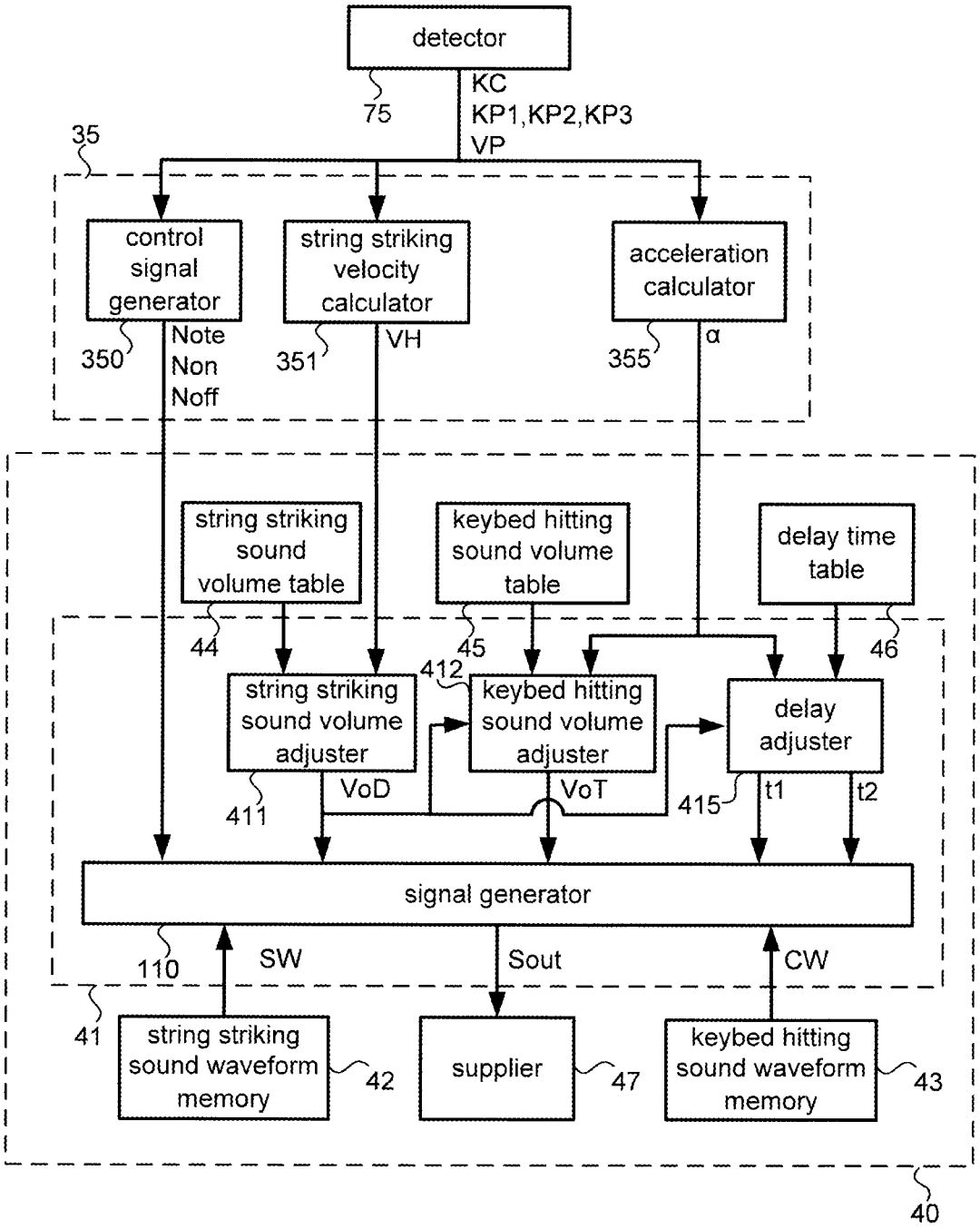
FIG. 10 is a block diagram showing functions of the electronic keyboard musical instrument.

FIG. 10 is a block diagram showing functions of the electronic keyboard musical instrument 1. Components in FIG. 10 that are the same as those shown in FIGS. 2 and 3 are given the same signs and are not described below. The CPU 35 executes the respective functions of a control signal generator 350, a string striking velocity calculator 351, and an acceleration calculator 355. The controller 41 executes the respective functions of a signal generator 110, a string striking sound volume adjuster 411, a keybed hitting sound volume adjuster 412, and a delay adjuster 415.

The signal generator 110 generates a signal representing a string striking sound (string striking sound signal) and a keybed hitting sound (keybed hitting sound signal) on the basis of parameters output from the control signal generator 350, the string striking sound volume adjuster 411, the keybed hitting sound volume adjuster 412, and the delay adjuster 415 and outputs the signals.

The control signal generator 350 generates a control signal that defines the contents of sound production on the basis of a detection signal outputted from the detector 75. The detection signal contains key-indicating information KC, signals KP1, KP2, and KP3 that are output when the switches A to C are on, respectively, and an output signal VP from the pressure sensor H. In this example, this control signal is MIDI-format data, a note number Note, a note-on Non, and a note-off Noff are generated and output to the signal generator 110. The control signal generator 350 generates and outputs the note-on Non when the signal VP is output from the detector 75. The note number Note is determined on the basis of a signal KC output in correspondence with the signal VP. Meanwhile, after having generated the note-on Non, the control signal generator 350 generates and outputs the note-off Noff when the outputting of the signal KP1 of the corresponding key number KC is stopped.

The string striking velocity calculator 351 calculates the hammer velocity VH on the basis of a signal output from the detector 75. For example, the hammer velocity VH is calculated on the basis of the voltage value of VP. The acceleration calculator 355 calculates the key depressing acceleration $\alpha$ on the basis of a signal output from the detector 75. For example, the key depressing acceleration $\alpha$ is calculated on the basis of the output time difference (which corresponds to tAB) between KP1 and KP2 and an output time difference (which corresponds to tBC) between KP2 and KP3. The hammer velocity VH and the key depressing acceleration $\alpha$ are output in association with the aforementioned control signal.

The string striking sound volume adjuster 411 determines the string striking sound volume VoD from the hammer velocity VH with reference to the string striking sound volume table 44. The keybed hitting sound volume adjuster 412 determines the keybed hitting sound volume VoT from the string striking sound volume VoD and the key depressing acceleration $\alpha$ with reference to the keybed hitting sound volume table 45. The delay adjuster 415 determines the delay times t1 and t2 from the string striking sound volume VoD and the key depressing acceleration $\alpha$ with reference to the delay time table 46.

Figure 11:
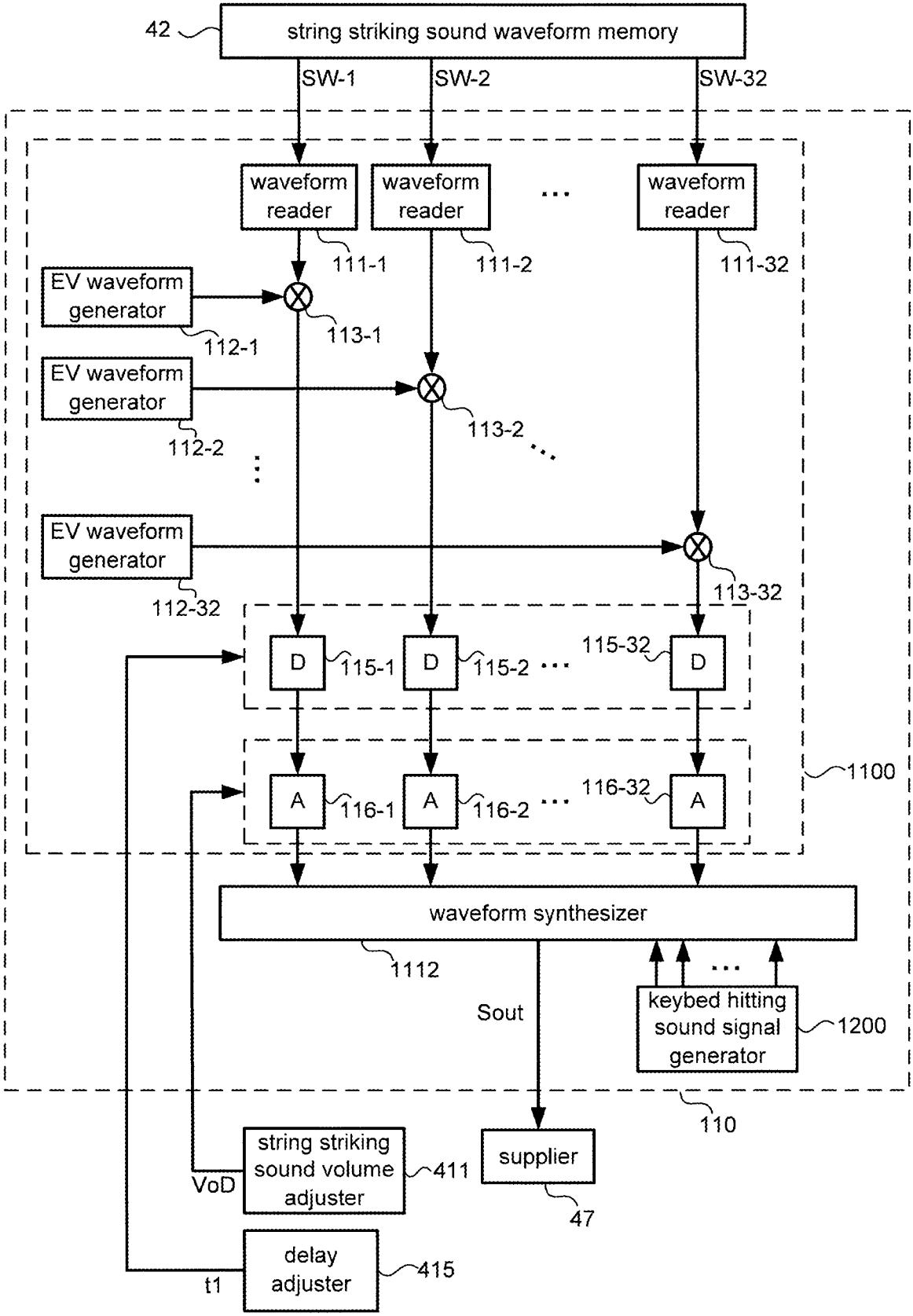
FIG. 11 is a block diagram showing functions of a signal generator and, in particular, is a block diagram showing functions of a string striking sound signal generator.

FIG. 11 is a block diagram showing functions of the signal generator 110 and, in particular, is a block diagram showing functions of a string striking sound signal generator. The signal generator 110 includes the string striking sound signal generator 1100, a keybed hitting sound signal generator 1200, and a waveform synthesizer 1112. The string striking sound signal generator 1100 generates a string striking sound signal on the basis of a signal output from the detector 75. The keybed hitting sound signal generator 1200 generates a hitting sound signal on the basis of a detection signal output from the detector 75. The waveform synthesizer 1112 generates a sound signal Sout by synthesizing a string striking sound signal generated by the string striking sound signal generator 1100 and a keybed hitting sound signal generated by the keybed hitting sound signal generator 1200 and outputs the sound signal Sout. The sound signal Sout is supplied from the supplier 47 to the sound system 38.

The string striking sound signal generator 1100 includes waveform readers 111 (waveform readers 111-*k*; k=1~n), EV (envelope) waveform generators 112 (112-*k*; k=1~n), multipliers 113 (113-*k*; k=1~n), delay devices 115 (115-*k*; k=1~n), and amplifiers 116 (116-*k*; k=1~n). The "n" corresponds to the number of sounds that can be simultaneously produced (i.e. the number of sound signals that can be simultaneously generated) and, in this example, is 32. That is, according to the string striking sound signal generator 1100, a state of production of sounds by thirty-two key depressions can be maintained and, in a case where the thirty-third key depression takes place while all of the sounds are being produced, forcibly stops the sound signal corresponding to the first produced sound.

The waveform reader 111-1 selectively reads out string striking sound waveform data SW-1 to be read out from the string striking sound waveform memory 42 in accordance with a control signal (e.g. a note-on Non) obtained from the control signal generator 350 and generates a sound signal of a pitch corresponding to the note number Note. The waveform reader 111-1 continues to read out the string striking sound waveform data SW until the sound signal is generated in response to a note-off Noff.

The EV waveform generator 112-1 generates an envelope waveform in accordance with the control signal obtained from the control signal generator 350 and preset parameters. For example the envelope waveform is defined by parameters such as an attack level AL, an attack time AT, a decay time DT, a sustain level SL, and a release time RT.

The multiplier 113-1 multiplies the sound signal generated by the waveform reader 111-1 by an envelope waveform generated by the EV waveform generator 112-1 and outputs the sound signal to the delay device 115-1.

The delay device 115-1 delays the sound signal in accordance with a set delay time and outputs the sound signal to the amplifier 116-1. This delay time is set on the basis of the delay time t1 determined by the delay adjuster 415. In this way, the delay adjuster 415 adjusts the production timing of a string striking sound signal.

The amplifier 116-1 amplifies the sound signal in accordance with a set amplification factor and outputs the sound signal to the waveform synthesizer 1112. This amplification factor is set on the basis of the string striking sound volume VoD determined by the string striking sound volume adjuster 141. In this way, the string striking sound volume adjuster 141 adjusts the output level of a string striking sound signal on the basis of the string striking sound volume VoD.

The foregoing has illustrated a case where k=1~(k=1~n). Note, however, that every time the next key depression takes place when the string striking sound waveform data SW-1 is being read out from the waveform reader 111-1, the control signal obtained from the control signal generator 350 is applied to k=2, 3, 4, . . . in sequence. For example, when the next key depression takes place, the control signal is applied to a configuration in which k=2, so that a sound signal is output from the multiplier 113-2 in the same manner as above. This sound signal is delayed by the delay device 115-2, amplified by the amplifier 116-2, and output to the waveform synthesizer 1112.

Figure 12:
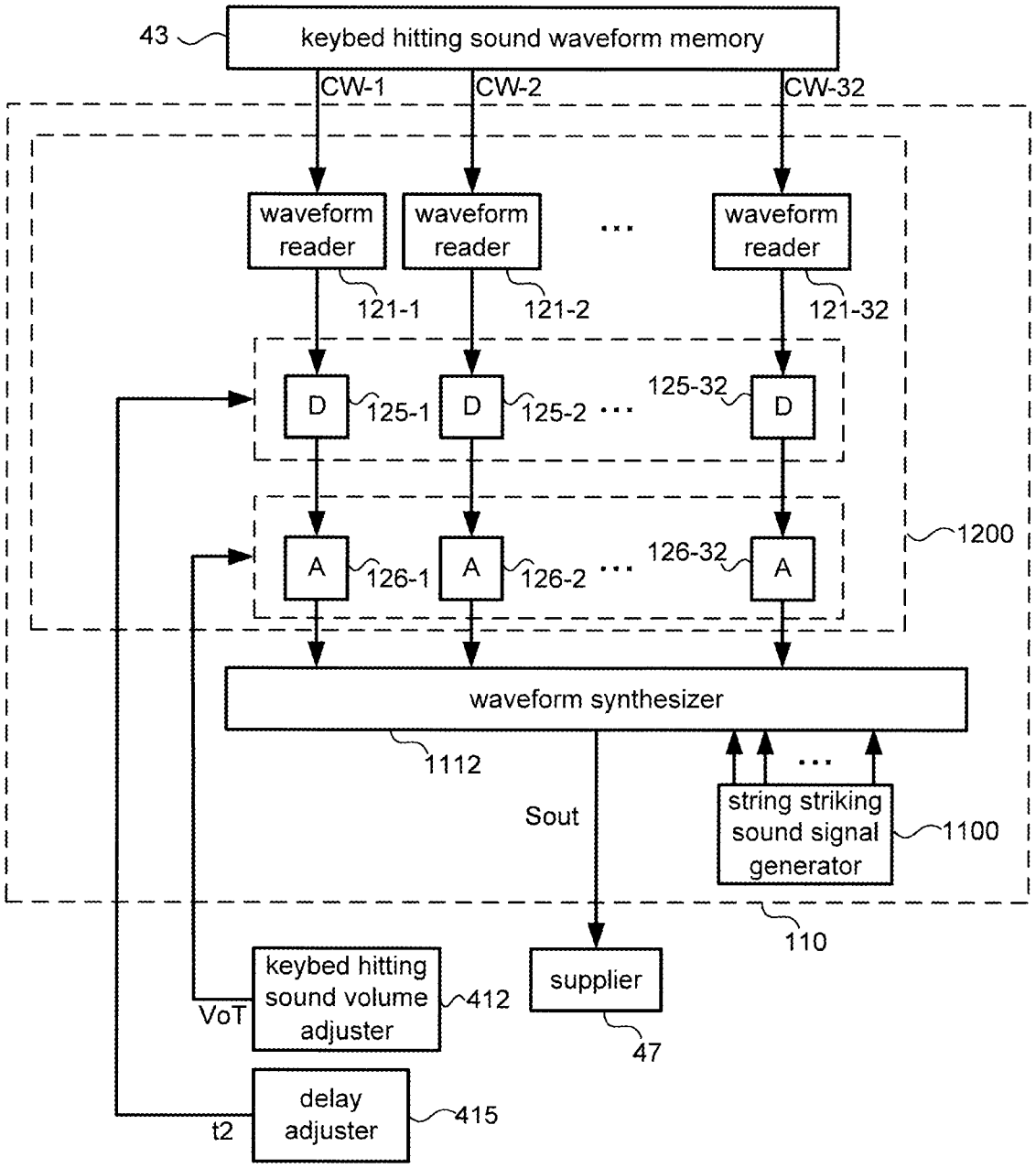
FIG. 12 is a block diagram showing functions of the signal generator and, in particular, is a block diagram showing functions of a keybed hitting sound signal generator.

FIG. 12 is a block diagram showing functions of the signal generator 110 and, in particular, is a block diagram showing functions of the keybed hitting sound signal generator. The keybed hitting sound signal generator 1200 includes waveform readers 121 (waveform readers **121-*j*, j=1~m), delay devices 125 (125-*j*, j=1~m), and amplifiers 126 (126-*j*, j=1~m). The "m" corresponds to the number of sounds that can be simultaneously produced (i.e. the number of sound signals that can be simultaneously generated) and, in this example, is 32. In this case, "m" is equal to "n" of the string striking sound signal generator 1100. According to the keybed hitting sound signal generator 1200** a state of production of sounds by thirty-two key depressions and be maintained and, in a case where the thirty-third key depression takes place while all of the sounds are being produced, forcibly stops the sound signal corresponding to the first produced sound. It should be noted that "m" may be less than "n" ("m<n") since, in most cases, it takes a shorter time to read out keybed hitting sound waveform data CW than to read out string striking sound waveform data SW.

The waveform reader 121-1 selectively reads out hitting sound waveform data CW-1 to be read out from the keybed hitting sound waveform memory 43 in accordance with a control signal (e.g. a note-on Non) obtained from the control signal generator 350, generates a sound signal, and outputs the sound signal to the delay device 125-1. As mentioned above, regardless of a note-off Noff, the waveform reader 121-1 finishes the readout when it has read out the hitting sound waveform data CW-1 to the end.

The delay device 125-1 delays the sound signal according to a set delay time and outputs the sound signal to the amplifier 126-1. This delay time is set on the basis of the delay time t2 determined by the delay adjuster 415. In this way, the delay adjuster 415 adjusts the production timing of a keybed hitting sound signal. That is, a relative relationship between the production timing of a string striking sound signal and the production timing of a hitting sound signal is adjusted by the delay adjuster 415.

The amplifier 126-1 amplifies the sound signal according to a set amplification factor and outputs the sound signal to the waveform synthesizer 1112. This amplification factor is set on the basis of the keybed hitting sound volume VoT determined by the keybed hitting sound volume adjuster 412. In this way, the keybed hitting sound volume adjuster 412 adjusts the output level of a keybed hitting sound signal on the basis of the keybed hitting sound volume VoT.

The foregoing has illustrated a case where j=1~(j=1~m). Note, however, that every time the next key depression takes place when the hitting sound waveform data CW-1 is being read out from the waveform reader 121-1, the control signal obtained from the control signal generator 350 is applied to j=2, 3, 4, . . . in sequence. For example, when the next key depression takes place, the control signal is applied to a configuration in which j=2, so that a sound signal is output from the waveform reader 121-2 in the same manner as above. This sound signal is delayed by the delay device 125-2, amplified by the amplifier 126-2, and outputted to the waveform synthesizer 1112.

The waveform synthesizer 1112 synthesizes a string striking sound signal output from the string striking sound signal generator 1100 and a keybed hitting sound signal output from the keybed hitting sound signal generator 1200 and outputs the synthesized sound signal to the supplier 47. The foregoing has described a configuration for achieving the functions of the electronic keyboard musical instrument 1 and, in particular, the functions of the CPU 35 and the sound generator 40.

Effects of First Embodiment (1) Implementation of an electronic keyboard musical instrument 1 provided with a signal supply device of the first embodiment described above makes it possible to adjust a relationship between a string striking sound volume and a keybed hitting sound volume and a relationship in production timing between a string striking sound and a keybed hitting sound. This makes it possible to reproduce changes in string striking sound volume and keybed hitting sound volume in an actual acoustic piano and reproduce relative changes in sound production timing of string striking sounds and keybed hitting sounds. That is, use of the electronic keyboard musical instrument 1 makes it possible to produce sounds which are similar to those produced by playing an acoustic piano.

(2) Since a physical phenomenon in an acoustic piano where the keybed hitting sound volume and the production timings of a string striking sound and a keybed hitting sound are determined according to the key depressing acceleration and the string striking sound volume is determined according to the hammer velocity can be reproduced, the production of sounds according to performance expression on an acoustic piano can be reproduced.

Other Embodiments

Although the foregoing has described embodiments of the present invention, the embodiments of the present invention can be modified in various forms as below. Further, the embodiments described above and the modifications to be described below can be applied in combination with each other.

(1) A key depressing velocity may be computed on the basis of the time tAB from the turning on of the switch A to the turning on of the switch B when the key is depressed, and on the basis of the key depressing velocity thus computed, the keybed hitting sound volume VoT and the delay times t1 and t2 may be determined.

(2) Although the switches A to C are used as a mechanism for detecting a movement of a key, this is not intended to imply any limitation. For examples, the switches A to C may be replaced by a multiresolution or continuous-quantity-variable stroke sensor so that the position of a key is continuously detected. For example, an optical sensor is provided in a predetermined site on the hammer 16, and a reflecting member is provided in a site where the reflecting member faces the optical sensor and does not move. Then, the optical sensor emits light to the reflecting member, receives light reflected by the reflecting member, and outputs a signal corresponding to a change in amount of light received by the optical sensor to the CPU 35. Then, the CPU 35 computes the hammer velocity VH according to change in the input signal. Further, the reflecting member provided with a gray scale may be used. The "gray scale" here is composed of white, black, and shades of gray whose concentration values are gradually set, and is used for expressing an image with light and dark from white to black.

(3) Instead of the pressure-sensitive switches serving as the switches A to C, sensors such as magnetic sensors or capacitive sensors may be used.

(4) In the control of a program according to the embodiment described above, the output value of the pressure sensor is obtained on the premise that a post-detection process can be sufficiently hastened, so that both a keybed hitting sound and a string striking sound are controlled. Alternatively, when a keybed hitting sound is produced earlier than a string striking sound, a process for producing a keybed hitting sound may be started at a point of time where information from the switches A to C has been obtained. That is, modes of control are subject to various changes and are not limited to the aforementioned flow charts.

(5) In the embodiment described above, a string striking sound is controlled by the output of the pressure sensor by a hitting of the hammer. Alternatively, the string striking sound volume VoD may be controlled by using a value, as a velocity value, calculated from a difference between times at which at least some of the switches A to C are turned on in combination.

(6) In each of the embodiments described above, the acoustic musical instrument whose sounds are to be sampled is an acoustic piano. Alternatively, the acoustic musical instrument whose sounds are to be sampled may be an acoustic musical instrument such as a celesta, a cembalo (harpsichord), or a glockenspiel.

(7) Adjusting modes of generation of string striking sound waveform data and keybed hitting sound waveform data allows a configuration in which at least either the pitches or tones of a string striking sound and a keybed hitting sound and the sound production timings of the string striking sound and the keybed hitting sound are adjusted instead of or in addition to the volumes of the string striking sound and the keybed hitting sound. For example, a string striking sound and a keybed hitting sound are adjusted according to the hammer velocity or the key depressing acceleration with reference to a table of correspondence between pitches or tones and hammer velocities or key depressing accelerations. Implementation of an electronic keyboard musical instrument thus configured makes it possible to reproduce a pitch or tone which is similar to that effected by playing an actual acoustic piano and, furthermore, give a performance with sound volume reproduction.

What is claimed is:

1. A signal supply device comprising:

a sound generator configured to generate a first sound signal and a second sound signal;

one or more sensors that detect an operation movement parameter of an operation body imparted by an operation input;

a memory storing instructions; and a processor that implements the instructions to execute a plurality of tasks, including:

a sound generating task that controls the sound generator to generate the first sound signal and the second sound signal in accordance with an instruction signal, including the operation movement parameter of the operation body detected by the one or more sensors, and linked member information corresponding to a movement of a linked member linked with the operation body; and an adjusting task that adjusts a relationship between the first sound signal and the second sound signal on the basis of the detected operation movement parameter and the linked member information.

2. The signal supply device according to claim 1, wherein the relationship includes a relationship in production timing between the first sound signal and the second sound signal.

3. The signal supply device according to claim 2, wherein the adjusting task calculates a velocity or acceleration of the operation body on the basis of the detected operation movement parameter and adjusts the relationship in production timing on the basis of the velocity or acceleration.

4. The signal supply device according to claim 2, wherein the adjusting task calculates an acceleration of the operation body on the basis of the detected operation movement parameter and adjusts the relationship in production timing so that a time from a production timing of the second sound signal to a production timing of the first sound signal becomes longer as the acceleration is higher.

5. The signal supply device according to claim 3, wherein:

the adjusting task calculates a velocity of the linked member on the basis of the linked member information and changes modes of adjustment of the relationship in production timing according to the velocity, and in a case where the velocity takes on a predetermined value, the adjusting task adjusts the relationship in production timing so that the second sound signal is generated before the first sound signal when the acceleration takes on a first value and the second sound signal is generated after the first sound signal when the acceleration takes on a second value that is smaller than the first value.

6. The signal supply device according to claim 1, wherein the relationship includes a relationship in output level between the first sound signal and the second sound signal.

7. The signal supply device according to claim 6, wherein the adjusting task calculates a velocity of the linked member on the basis of the linked member information and adjusts the relationship in output level on the basis of the velocity.

8. The signal supply device according to claim 1, wherein the instruction signal is generated on the basis of a detection result yielded by the one or more sensors, which comprise a plurality of sensors that detect the operation body or the linked member linked with the operation body in a plurality of positions.

9. The signal supply device according to claim 1, wherein the instruction signal is generated on the basis of a detection result yielded by the one or more sensors, which comprises one sensor that detects the operation body or the linked member linked with the operation body in a continuous position.

10. The signal supply device according to claim 1, wherein:

the first sound signal represents a musical sound produced by a sounding body of an acoustic musical instrument, and the second sound signal represents a hitting sound produced by a collision between a performance operator operated in causing the sounding body to produce a sound and another member.

11. A keyboard device comprising:

the signal supply device according to claim 1;

a plurality of keys each comprising the operation body; and a plurality of hammers each comprising the linked member.

12. The keyboard device according to claim 11, wherein:

the plurality of keys include a first key and a second key, and the sound generator is configured to effect a variation in pitch of the first sound signal between a case where the first key is operated and a case where the second key is operated and to effect no variation in pitch of the second sound signal or varies the pitch of the second sound signal with a smaller pitch difference than the variation in pitch of the first sound signal.

13. The signal supply device according to claim 8, wherein the plurality of sensors detect the operation movement parameter by detecting positions of the operation body at different timings.

14. A non-transitory computer-readable storage medium storing a program executable by a computer to execute a method comprising:

generating a first sound signal and a second sound signal in accordance with an instruction signal, including an operation movement parameter of an operation body detected by one of more sensors, and linked member information corresponding to a movement of a linked member linked with the operation body; and adjusting a relationship between the first sound signal and the second sound signal on the basis of the detected operation movement parameter and the linked member information.

15. The non-transitory computer-readable storage medium according to claim 14, wherein the relationship includes a relationship in production timing between the first sound signal and the second sound signal.

16. The non-transitory computer-readable storage medium according to claim 15, wherein the adjusting includes calculating a velocity or acceleration of the operation body on the basis of the detected operation movement parameter and adjusting the relationship in production timing on the basis of the velocity or acceleration.

17. The non-transitory computer-readable storage medium according to claim 14, wherein the relationship includes a relationship in output level between the first sound signal and the second sound signal.

18. The non-transitory computer-readable storage medium according to claim 14, wherein the relationship includes a relationship in tone or pitch between the first sound signal and the second sound signal.

19. The non-transitory computer-readable storage medium according to claim 14, wherein:

the first sound signal represents a musical sound produced by a sounding body of an acoustic musical instrument, and the second sound signal represents a hitting sound produced by a collision between a performance operator operated in causing the sounding body to produce a sound and a different member.

20. The non-transitory computer-readable storage medium according to claim 14, where the method further comprises generating the instruction signal on the basis of a detection result yielded by the one or more sensors, which comprise a plurality of sensors that detect the operation body or the linked member linked with the operation body in a plurality of positions.

* * * * *